US009878219B2

(12) United States Patent
Shimahara

(10) Patent No.: US 9,878,219 B2
(45) Date of Patent: Jan. 30, 2018

(54) GOLF CLUB AND GOLF CLUB SET

(71) Applicant: DUNLOP SPORTS CO. LTD., Kobe-shi, Hyogo (JP)

(72) Inventor: Yuki Shimahara, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/443,633

(22) Filed: Feb. 27, 2017

(65) Prior Publication Data

US 2017/0259131 A1 Sep. 14, 2017

(30) Foreign Application Priority Data

Mar. 11, 2016 (JP) ..... 2016-047745

(51) Int. Cl.
*A63B 53/04* (2015.01)
*A63B 53/00* (2015.01)

(52) U.S. Cl.
CPC ..... *A63B 53/047* (2013.01); *A63B 2053/005* (2013.01); *A63B 2053/0433* (2013.01)

(58) Field of Classification Search
CPC ..... A63B 2053/005; A63B 2053/0433
See application file for complete search history.

(56) References Cited

U.S. PATENT DOCUMENTS 6,471,601 B1 * 10/2002 McCabe ..... A63B 53/047 473/290
6,569,029 B1 * 5/2003 Hamburger ..... A63B 53/047 473/238
7,614,962 B1 * 11/2009 Clausen ..... A63B 53/047 473/291
2010/0041493 A1 * 2/2010 Clausen ..... A63B 53/047 473/291
2012/0238375 A1 * 9/2012 Park ..... A63B 53/04 473/331
2013/0324276 A1 * 12/2013 Stites ..... A63B 53/06 473/244
2015/0057096 A1 * 2/2015 Nicolette ..... A63B 53/047 473/290
2016/0199704 A1 * 7/2016 Shimahara ..... A63B 53/04 473/290
2017/0095710 A1 * 4/2017 Henrikson ..... A63B 53/0466

FOREIGN PATENT DOCUMENTS

JP 4525302 B2 8/2010

* cited by examiner

*Primary Examiner* — John E Simms, Jr.
(74) *Attorney, Agent, or Firm* — Birch, Stewart, Kolasch & Birch, LLP

(57) ABSTRACT

A golf club 4 includes a head hd and a sole surface 12. The sole surface 12 includes a ridgeline RL extending from a toe side toward a heel side, a leading surface Si positioned on a face side of the ridgeline RL and inclined upward toward the face side, and a trailing surface S2 positioned on a back side of the ridgeline RL and inclined upward toward the back side. Inclination angles at respective positions of the trailing surface S2 are defined as θ2*c* at a central position, θ2*t* at a toe reference position, and θ2*h* at a heel reference position. Then, the head hd satisfies at least one of the following (a) and (b):

(a) The inclination angle θ2*t* is greater than the inclination angle θ2*c*

(b) The inclination angle θ2*h* is greater than the inclination angle θ2*c*.

11 Claims, 20 Drawing Sheets

GOLF CLUB AND GOLF CLUB SET

The present application claims priority on Patent Application No. 2016-047745 filed in JAPAN on Mar. 11, 2016, the entire contents of which are hereby incorporated by reference.

BACKGROUND OF THE INVENTION

Field of the Invention

The present invention relates to a golf club and a golf club set.

Description of the Related Art

Proposals in relation to a sole shape have been made in an iron type golf club. In a head described in Japanese Patent No. 4525302, a projection part is provided on a sole part. If the projection part is brought into contact with a ground, the head is rotated by the ground resistance in a direction in which a loft angle with respect to a vertical direction is decreased. Backspin can be increased by a gear effect based on the rotation. Japanese Patent Application Laid-Open Publication No. 2015-47305 (US2016/0199704) discloses a head which includes a sole having a boundary line extending in a toe-heel direction and being capable of being visually recognized. The sole includes a leading surface inclined to a face side and a trailing surface inclined to aback side with the boundary line as a top part. Since the head can intensively receive resistance in the top part, the gear effect can be produced at once, which can provide an increase in a backspin rate.

SUMMARY OF THE INVENTION

A golf club is used in various situations. For example, an iron type golf club (iron club) is most commonly used when hitting a golf ball directly placed on grass, and is used in various situations where the inclinations of the ground, or the like are different. A hybrid type golf club also has the same circumstances. Furthermore, for example, high-level golf players tend to obtain desired hit balls by various swings, and clubs having excellent operativity are required. In addition, in a club set, each of iron numbers has different role. Therefore, various performances are required for clubs.

As a result of the extensive studies, the present inventors have found that performance required for a golf club is more complicated than performance considered hitherto.

The present embodiment provides a golf club which can satisfy various required performances.

In one aspect, a golf club includes: a shaft; a head attached to a tip part of the shaft; and a grip attached to a rear end part of the shaft. The head includes a sole surface and a face surface having a face line. The sole surface includes a ridgeline extending from a toe side toward a heel side, a leading surface positioned on a face side of the ridgeline and inclined upward toward the face side, and a trailing surface positioned on a back side of the ridgeline and inclined upward toward the back side. If an inclination angle of the trailing surface is defined as θ2; the inclination angle θ2 at a central position of the face line is defined as θ2*c*; the inclination angle θ2 at a toe reference position is defined as θ2*t*; and the inclination angle θ2 at a heel reference position is defined as θ2*h*, the golf club satisfies at least one of the following (a) and (b). Preferably, the golf club satisfies both the following (a) and (b):

(a) the inclination angle θ2*t* is greater than the inclination angle θ2*c*; and (b) the inclination angle θ2*h* is greater than the inclination angle θ2*c*.

In another aspect, a trailing edge which is a rear edge of the trailing surface is curved so as to project toward the face side.

In another aspect, a width of the trailing surface is greater than a width of the leading surface at all positions in a toe-heel direction.

In another aspect, the head is an iron type head.

In another aspect, a golf club set is constituted by the golf clubs, and includes the two or more golf clubs having different loft angles. The golf club set satisfies at least one of the following (c) and (d). Preferably, the golf club set satisfies both the following (c) and (d):

(c) the inclination angle θ2*t* is increased as the loft angle is increased.

(d) the inclination angle θ2*h* is increased as the loft angle is increased.

In another aspect, a golf club set is constituted by the golf club, and includes the two or more golf clubs having different loft angles. If a difference (θ2*t*−θ2*c*) between the inclination angle θ2*t* and the inclination angle θ2*c* is defined as a toe angle difference, and a difference (θ2*h*−θ2*c*) between the inclination angle θ2*h* and the inclination angle θ2*c* is defined as a heel angle difference, the golf club set satisfies at least one of the following (e) and (f). Preferably, the golf club set satisfies both the following (e) and (f):

(e) the toe angle difference is increased as the loft angle is increased.

(f) the heel angle difference is increased as the loft angle is increased.

In another aspect, in the club set, the inclination angle θ2*c* is increased as the loft angle is increased.

An inclination angle of the leading surface is defined as θ1; the inclination angle θ1 at the central position is defined as θ1*c*; the inclination angle θ1 at the toe reference position is defined as θ1*t*; and the inclination angle θ1 at the heel reference position is defined as θ1*h*. In another aspect, in the club set, the angle θ1*t* is increased as the loft angle is increased. In another aspect, in the club set, the angle θ1*c* is increased as the loft angle is increased. In another aspect, in the club set, the angle θ1*h* is increased as the loft angle is increased.

and

Figure 20:
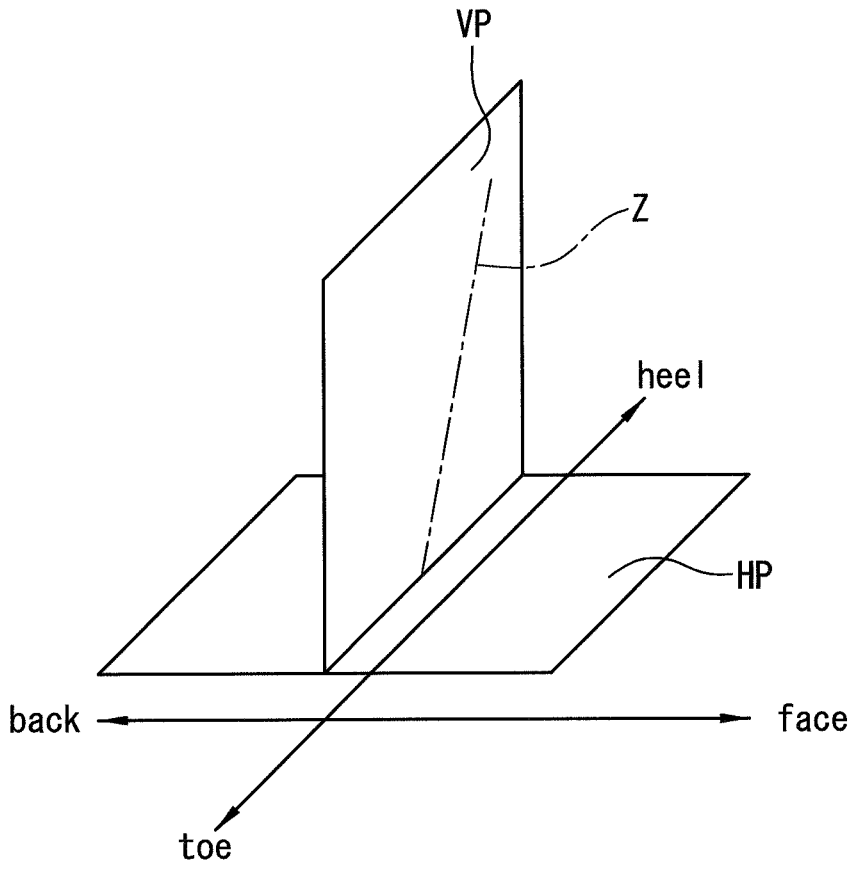

FIG. 20 is a perspective view showing a horizontal plane HP and a reference perpendicular plane VP in a reference state.

DESCRIPTION OF THE PREFERRED EMBODIMENTS

Hereinafter, some aspects will be described in detail according to the preferred embodiments with appropriate references to the accompanying drawings.

The present application includes the aspect of a golf club head, the aspect of a golf club, and the aspect of a golf club set. Hereinafter, the present embodiments will be described in detail with appropriate references to the accompanying drawings. Hereinafter, an iron type golf club will be described as one embodiment of the golf club.

Definitions of Terms

The definitions of terms in the present application are as follows.

[Reference State]

The reference state is a state where a head is placed on a horizontal plane HP in a state where the horizontal plane HP and a face line gv are parallel to each other. In the reference state, a center axis line Z (shaft axis line Z) of a shaft hole of the head is provided in a reference perpendicular plane VP (see FIG. 20). The reference perpendicular plane VP is a plane perpendicular to the horizontal plane HP. In the reference state, the face line gv is parallel to the horizontal plane HP, and parallel to the reference perpendicular plane VP.

[Toe-Heel Direction]

In the head of the reference state, the direction of an intersectional line between the reference perpendicular plane VP and the horizontal plane HP is the toe-heel direction. The toe-heel direction is parallel to the face line gv.

[Face-Back Direction]

A direction perpendicular to the toe-heel direction and parallel to the horizontal plane HP is the face-back direction. The face-back direction is also a front-rear direction. A face side is also referred to as a front side.

[Up-Down Direction]

A direction perpendicular to the toe-heel direction and perpendicular to the face-back direction is the up-down direction.

[Central Position of Face Line]

The central position of a longest face line gv1 in the toe-heel direction is a central position Pc of the face line (see FIG. 2 to be described later). The central position Pc is a position in the toe-heel direction. When the plurality of longest face lines gv1 are present, the central position Pc is determined based on the lowermost longest face line gv1.

[Toe Reference Position]

The position of a toe side end of the longest face line gv1 is a toe reference position Pt (see FIG. 2 to be described later). The toe reference position Pt is a position in the toe-heel direction. When the plurality of longest face lines gv1 are present, the toe reference position Pt is determined based on the lowermost longest face line gv1.

[Heel Reference Position]

The position of a heel side end of the longest face line gv1 is a heel reference position Ph (see FIG. 2 to be described later). The heel reference position Ph is a position in the toe-heel direction. When the plurality of longest face lines gv1 are present, the heel reference position Ph is determined based on the lowermost longest face line gv1.

[Leading Edge]

A point positioned on a frontmost side (face side) in a section of the head taken along the face-back direction is the leading edge.

[Trailing Edge]

The trailing edge is a back side edge (rear edge) of a sole surface. When the back side edge of the sole surface cannot be confirmed due to roundness or the like, the trailing edge can be determined as follows. When the curvature radius of the trailing surface is sequentially calculated toward rear in the section taken along the face-back direction, a point at which the curvature radius is first set to be equal to or less than 5 mm is the trailing edge.

[Sole Width]

A distance between the leading edge and the trailing edge is the sole width. The sole width is a distance in the face-back direction.

[Set]

Figure 1:
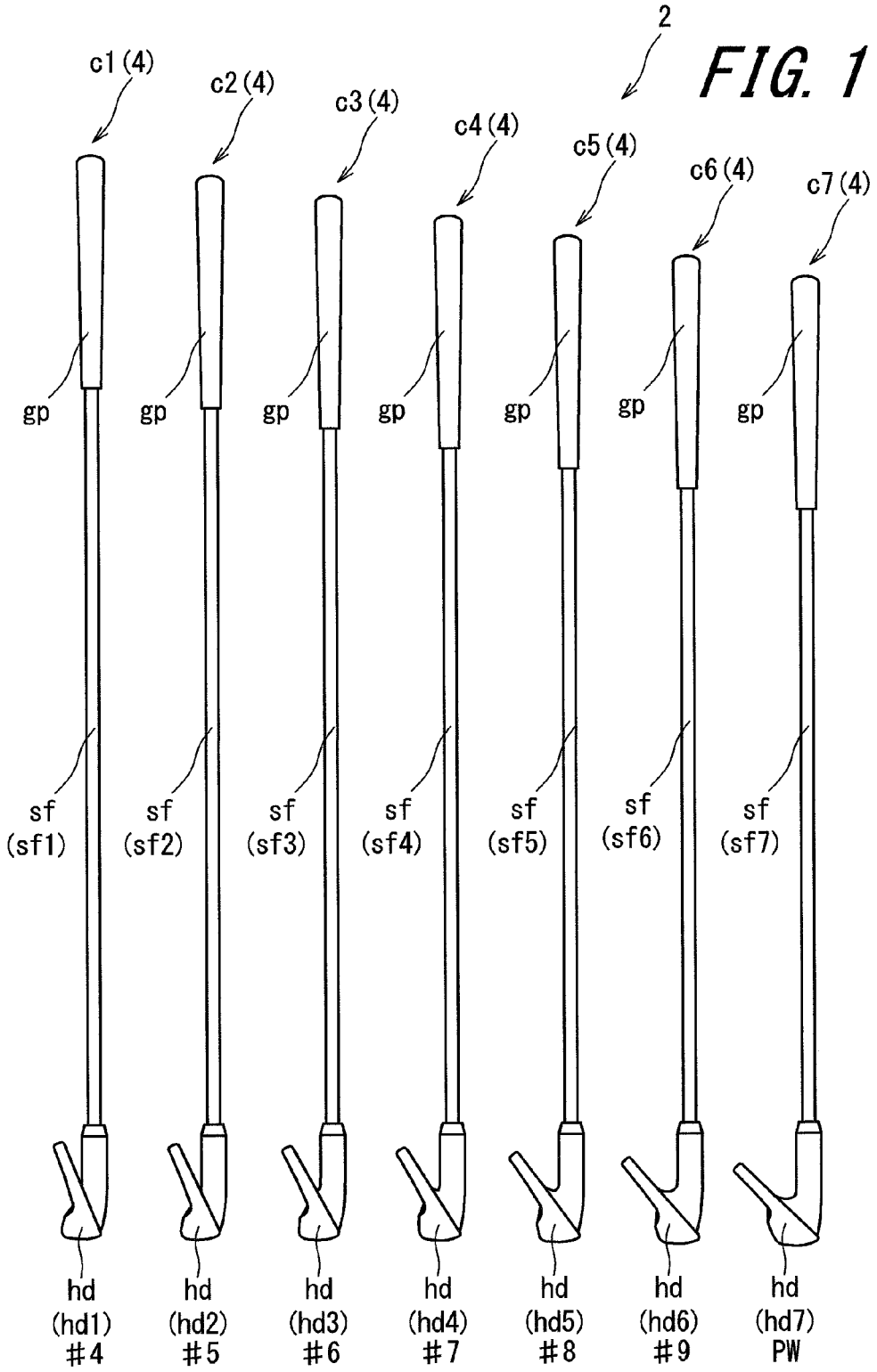
FIG. 1 shows an iron type golf club set according to a first embodiment.

FIG. 1 shows an iron type golf club set 2 according to one embodiment. In the present application, an iron type golf club set is also referred to as a golf club set, a club set, or a set. The loft angle of an iron type golf club is usually 15 degrees or greater but 70 degrees or less. Unless otherwise described, in the present application, the loft angle means a real loft angle. The real loft angle is a loft angle with respect to the shaft axis line Z.

The set 2 includes two or more iron type golf clubs 4 having loft angles different from each other. The set 2 includes two or more iron type golf clubs 4 having club lengths different from each other. The set 2 includes two or more iron type golf clubs 4 having club lengths and loft angles different from each other. In the set 2, the loft angle is increased as the club length is decreased.

In the set 2, the number of the clubs is 7. The number of the clubs of the set 2 is equal to or greater than 2. As long as the number of the clubs of the set 2 is equal to or greater than 2, the number of the clubs of the set 2 is not limited. From the viewpoint of emphasizing the effect of the present embodiment for the set, the number of the clubs of the set 2 is preferably equal to or greater than 3, more preferably equal to or greater than 4, still more preferably equal to or greater than 5, and yet still more preferably equal to or greater than 6. In the golf rule, the number of the clubs capable of being used during play is limited. From this viewpoint, the number of the clubs of the set 2 is preferably equal to or less than 11, more preferably equal to or less than 10, and still more preferably equal to or less than 9.

Each of the golf clubs 4 includes a shaft sf, a head hd, and a grip gp. The head hd is attached to a tip part of the shaft sf. The grip gp is attached to a rear end part of the shaft sf.

The set 2 includes golf clubs c1 to c7. The golf club c1 includes a shaft sf1, a head hd1, and a grip gp. The golf club c2 includes a shaft sf2, a head hd2, and a grip gp. The golf club c3 includes a shaft sf3, a head hd3, and a grip gp. The golf club c4 includes a shaft sf4, a head hd4, and a grip gp. The golf club c5 includes a shaft sf5, a head hd5, and a grip gp. The golf club c6 includes a shaft sf6, a head hd6, and a grip gp. The golf club c7 includes a shaft sf7, a head hd7, and a grip gp. The length of the shaft sf is decreased as the loft angle is increased.

The set 2 includes the golf club c1, the golf club c2, the golf club c3, the golf club c4, the golf club c5, the golf club c6, and the golf club c7 in a descending order of a club length from the club having the longest club length. The loft angle is increased as the club length is decreased. In some iron numbers (for example, wedges), the loft angles may be different, and the club lengths may be the same.

Although not illustrated, in the set 2, a lie angle is increased as the club length is decreased.

In the set 2, the iron numbers of the clubs are as follows. The golf club c1 is a 4-iron; the golf club c2 is a 5-iron; the golf club c3 is a 6-iron; the golf club c4 is a 7-iron; the golf club c5 is an 8-iron; the golf club c6 is a 9-iron; and the golf club c7 is a pitching wedge (PW). In the present disclosure, the iron number of the golf club 4 included in the set 2 is not limited.

In the set 2, the club length is decreased as the iron number is increased. The loft angle is increased as the iron number is increased. A difference between the loft angles of the adjacent iron numbers is usually 2 degrees or greater but 6 degrees or less.

In light of the effect (to be described later) of the present aspect for the set, the set 2 preferably includes at least two selected from the group consisting of the following first club, second club, and third club. More preferably, the set 2 includes the following first club, second club, and third club:

[first club]: a club having a loft angle of 22 degrees or greater but less than 28.5 degrees, and a club length of 37.25 inches or greater but 38.5 inches or less;

[second club]: a club having a loft angle of 28.5 degrees or greater but less than 36.5 degrees, and a club length of 36.25 inches or greater but less than 37.25 inches; and

[third club]: a club having a loft angle of 36.5 degrees or greater but 47 degrees or less, and a club length of 35 inches or greater but less than 36.25 inches.

The set 2 may include the following fourth club:

[fourth club]: a club having a loft angle of greater than 47 degrees but 70 degrees or less, and a club length of 35 inches or greater but 36 inches or less.

[Head]

Next, the head hd will be described. Hereinafter, the 4-iron, the 7-iron, and the pitching wedge will be exemplarily illustrated. The three iron numbers are only examples to the last.

Figure 2:
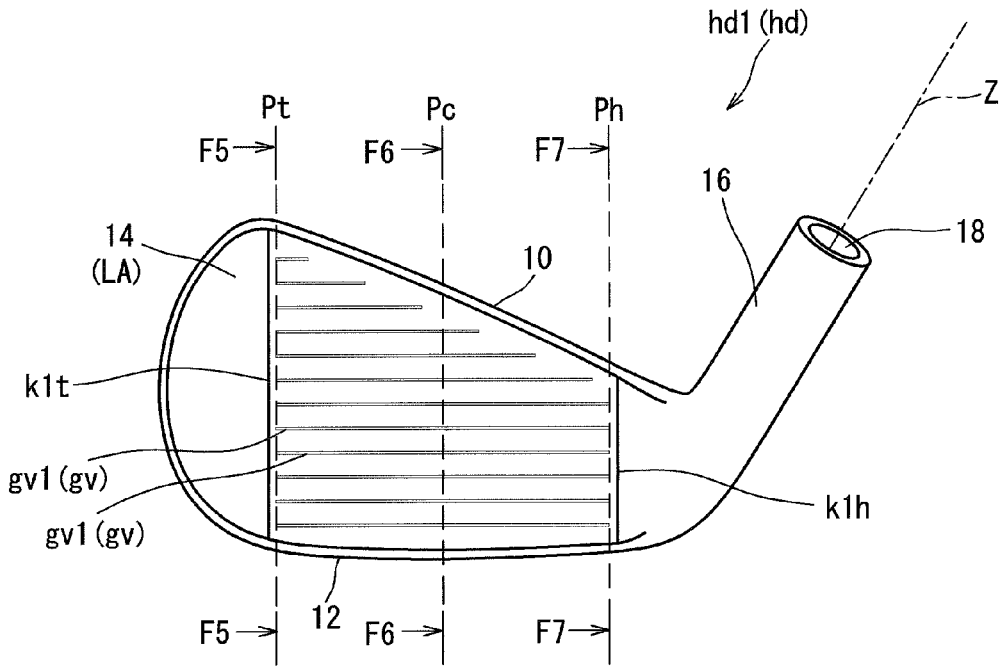
FIG. 2 is a front view of a head (4-iron) included in the set of FIG. 1, as viewed from the front of a face.
Figure 3:
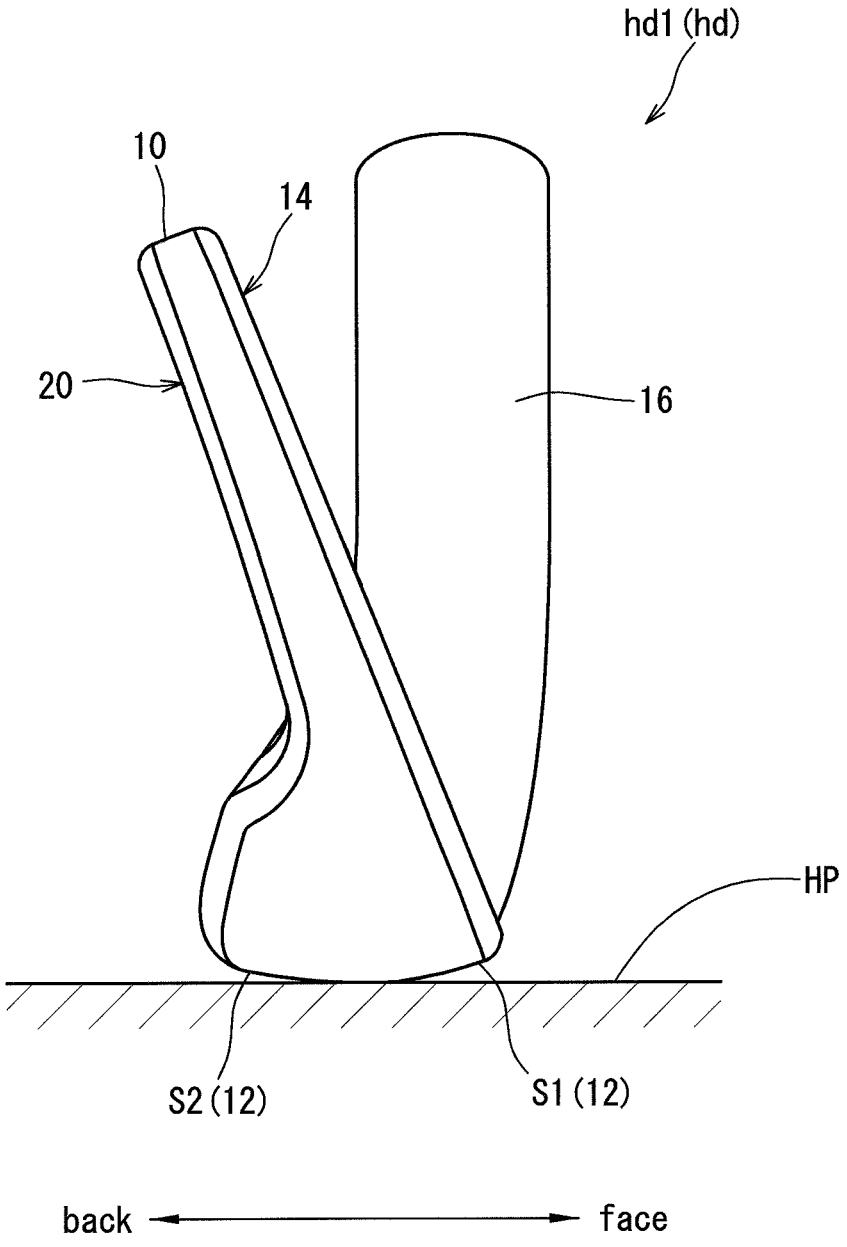
FIG. 3 is a side view of the head of FIG. 2.
Figure 4:
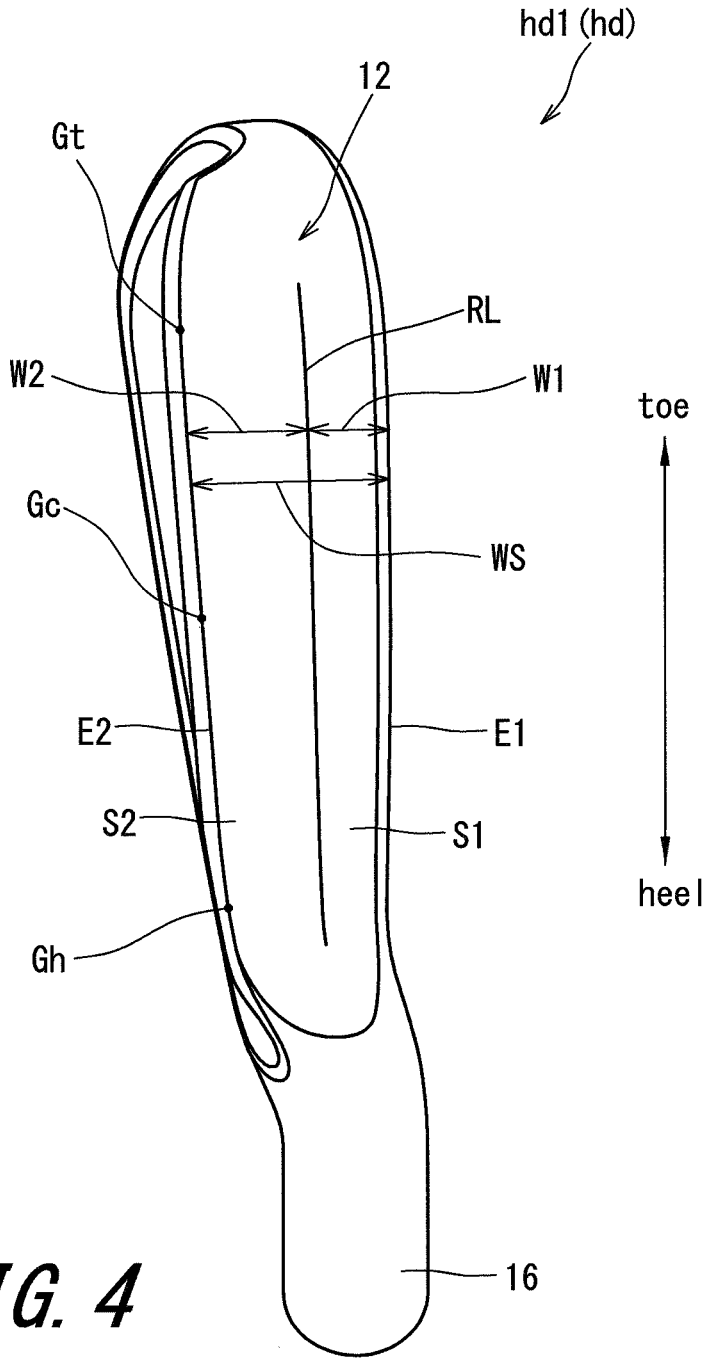
FIG. 4 is a bottom view of the head of FIG. 2.
Figure 5:
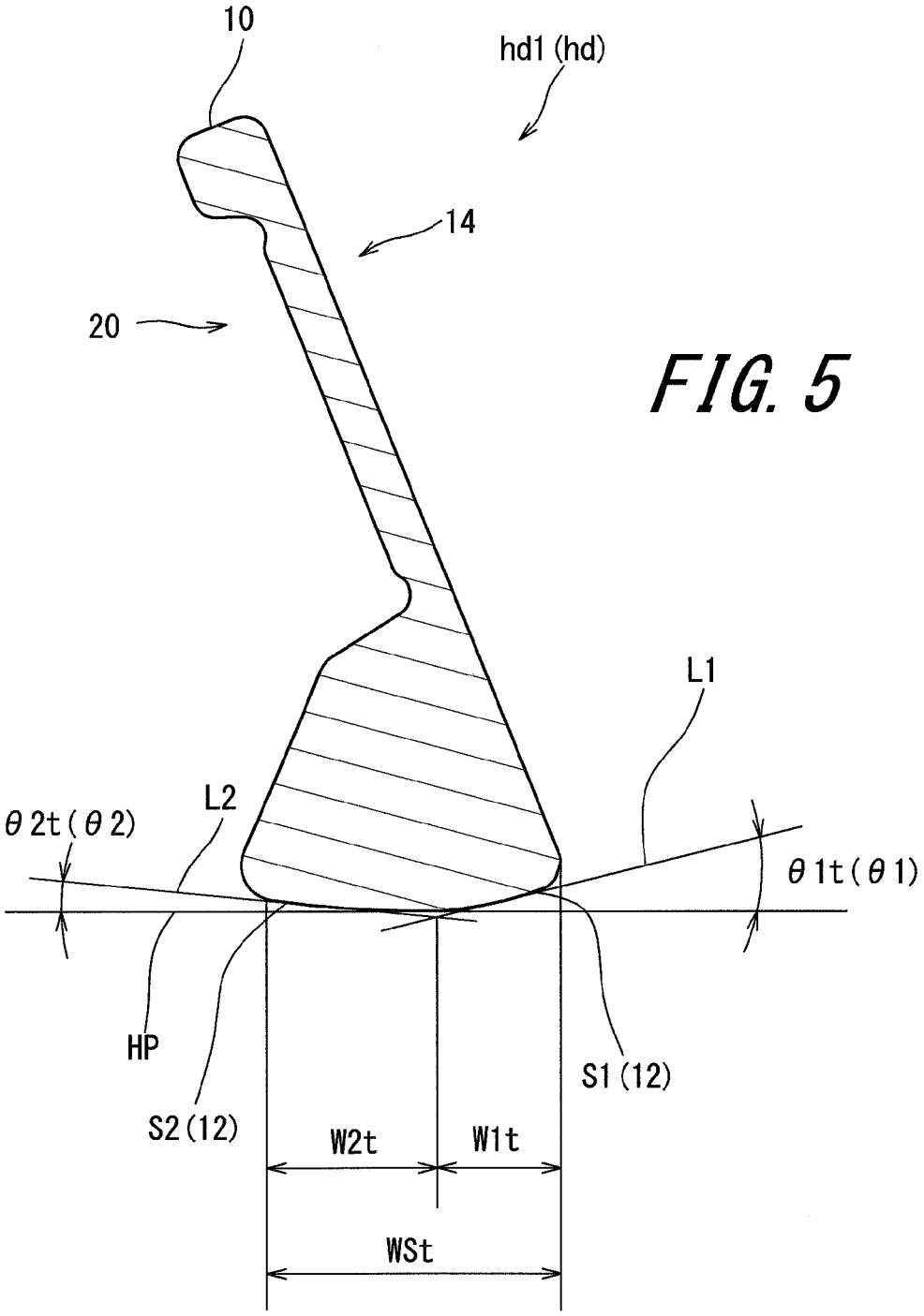
FIG. 5 is a sectional view taken along line F5-F5 of FIG. 2.
Figure 6:
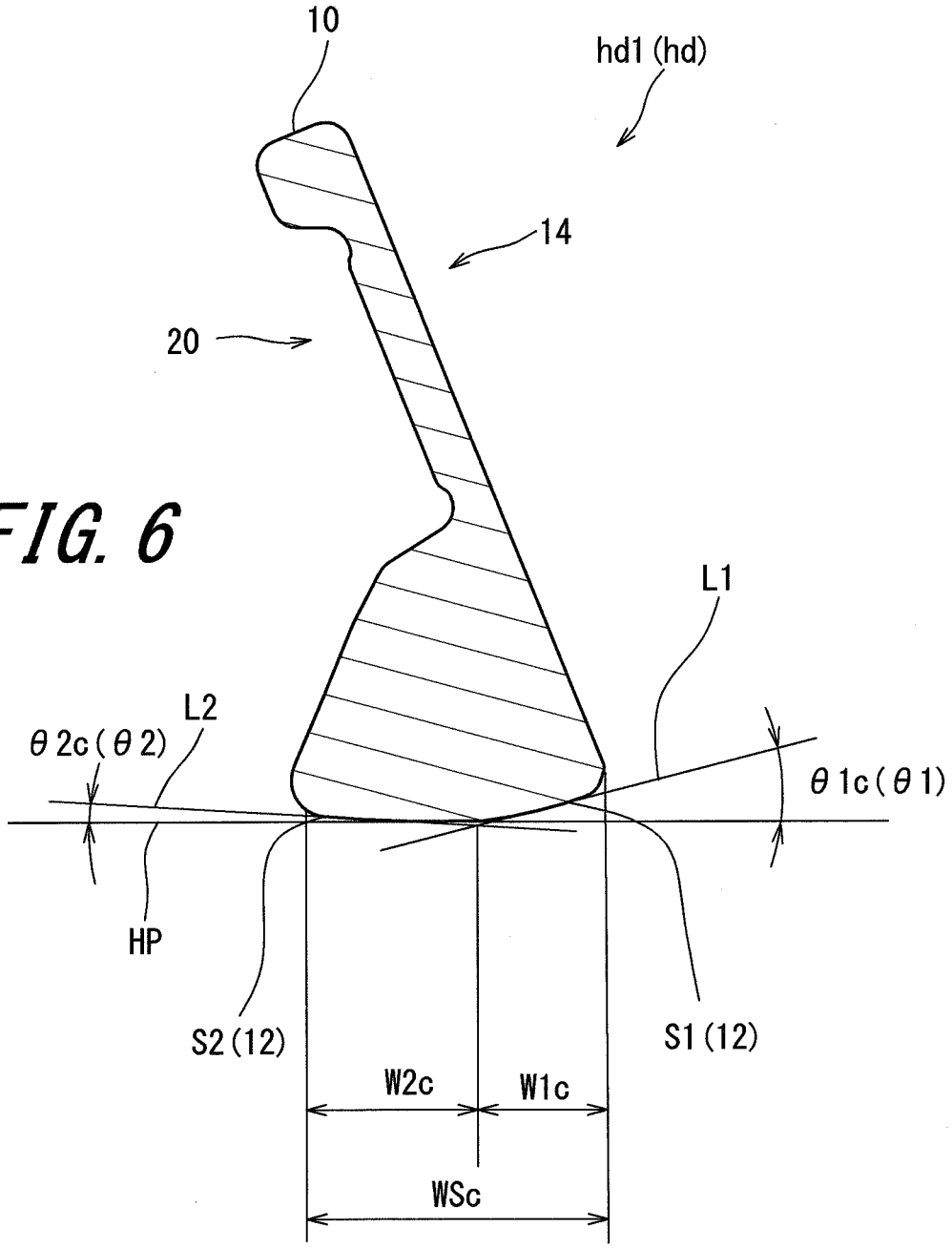
FIG. 6 is a sectional view taken along line F6-F6 of FIG. 2.
Figure 7:
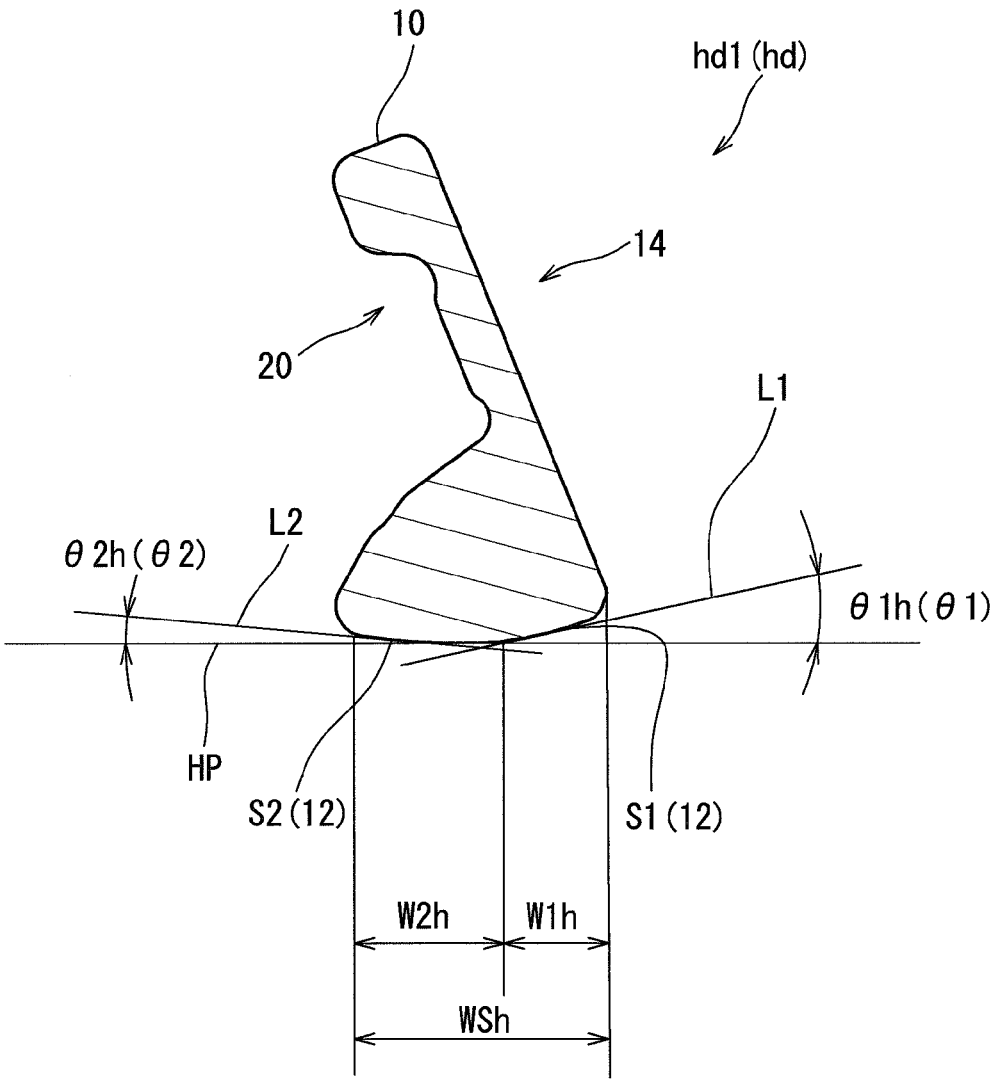
FIG. 7 is a sectional view taken along line F7-F7 of FIG. 2.

FIG. 2 is a front view of the head hd1 of the 4-iron (the above first club), as viewed from a direction perpendicular to a face surface. FIG. 3 is a side view of the head hd1. FIG. 4 is a bottom view of a head hd1, as viewed from a sole side. FIG. 5 is a sectional view taken along line F5-F5 of FIG. 2. FIG. 6 is a sectional view taken along line F6-F6 of FIG. 2. FIG. 7 is a sectional view taken along line F7-F7 of FIG. 2.

Figure 8:
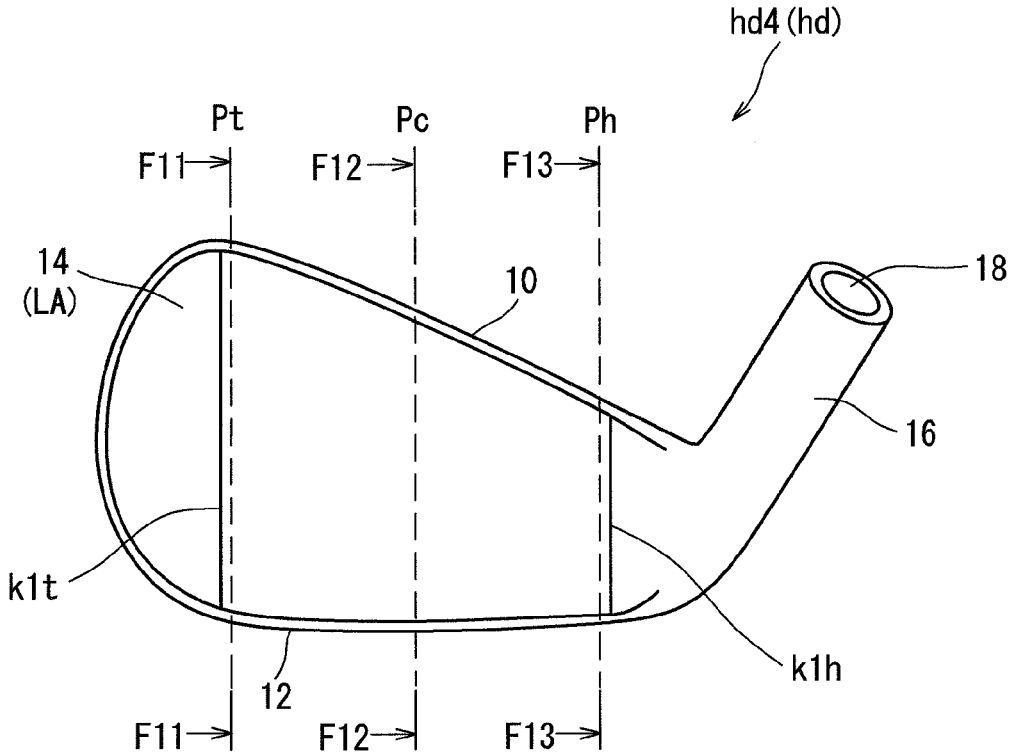
FIG. 8 is a front view of a head (7-iron) included in the set of FIG. 1, as viewed from the front of a face.
Figure 9:
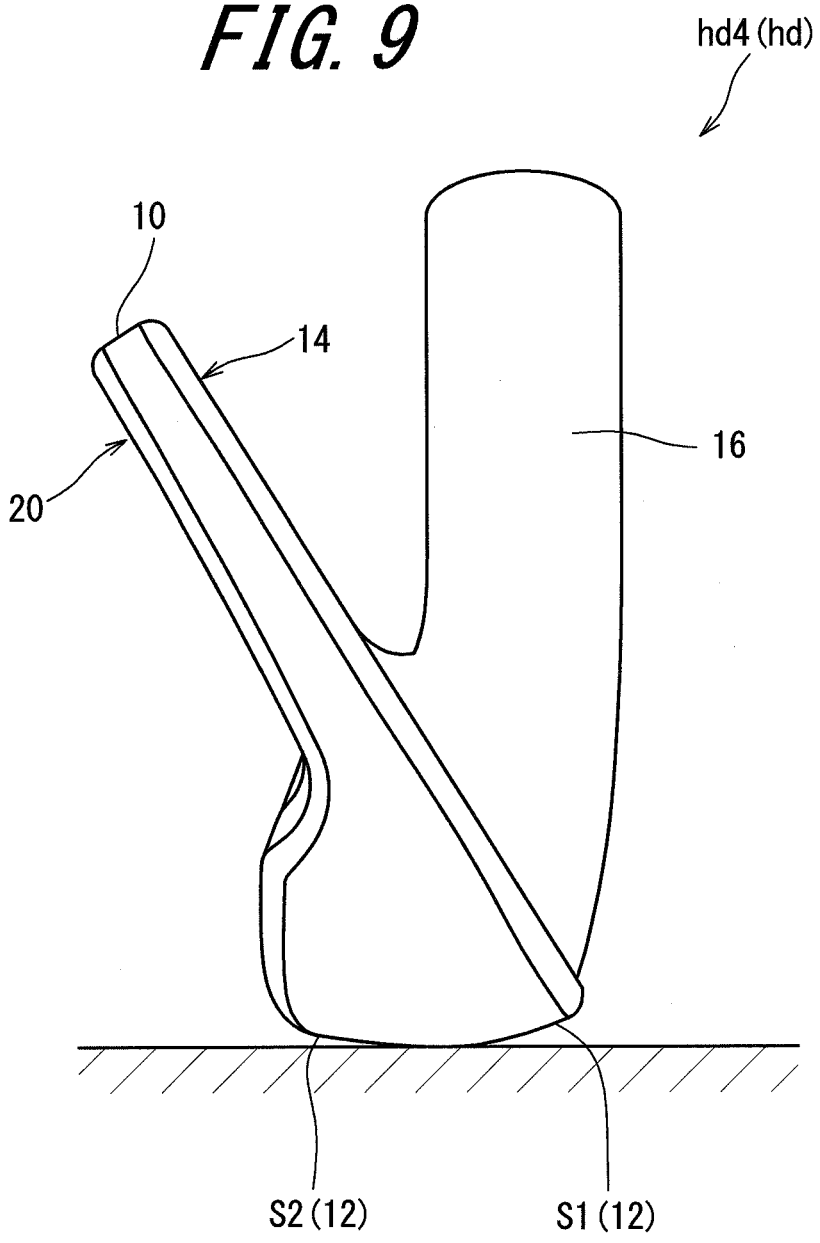
FIG. 9 is a side view of the head of FIG. 8.
Figure 10:
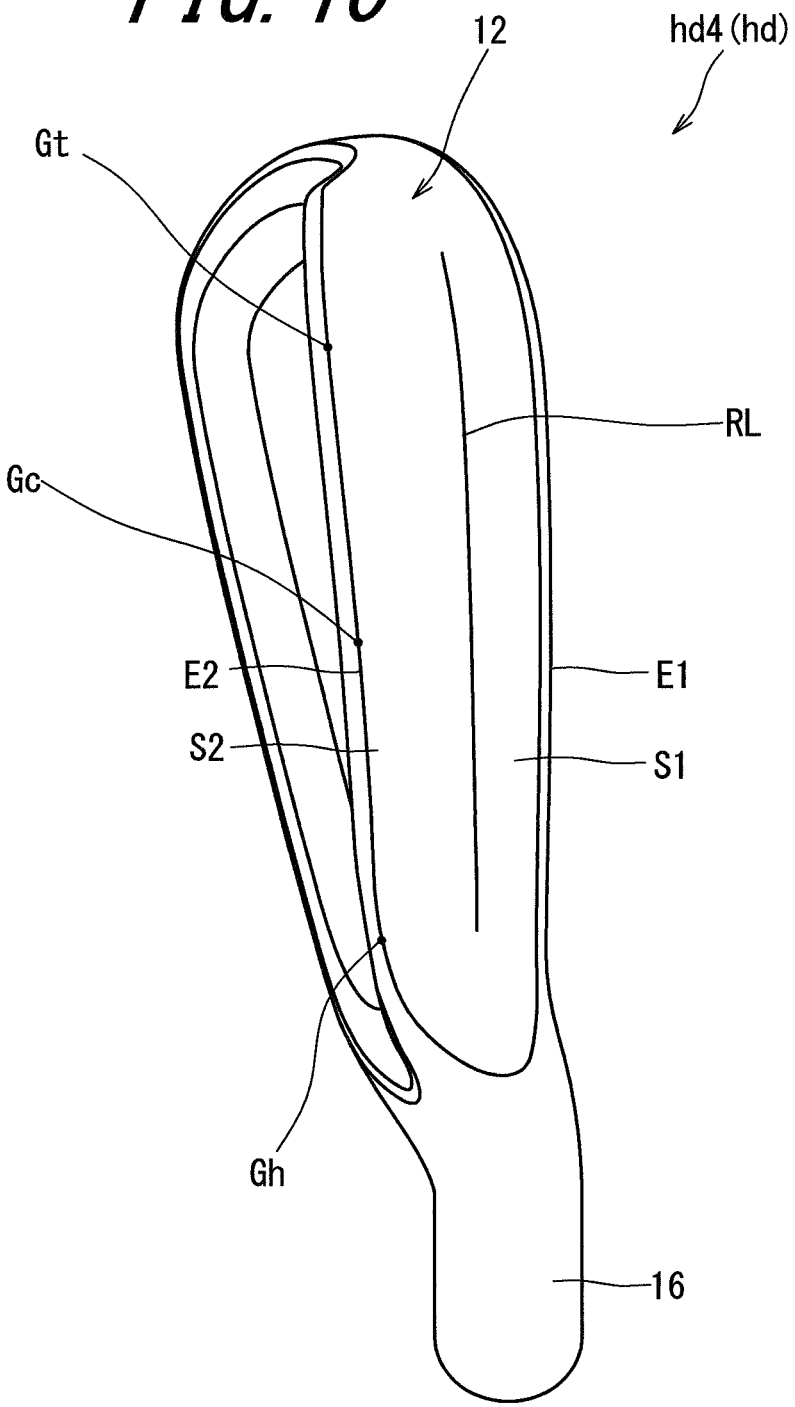
FIG. 10 is a bottom view of the head of FIG. 8.
Figure 11:
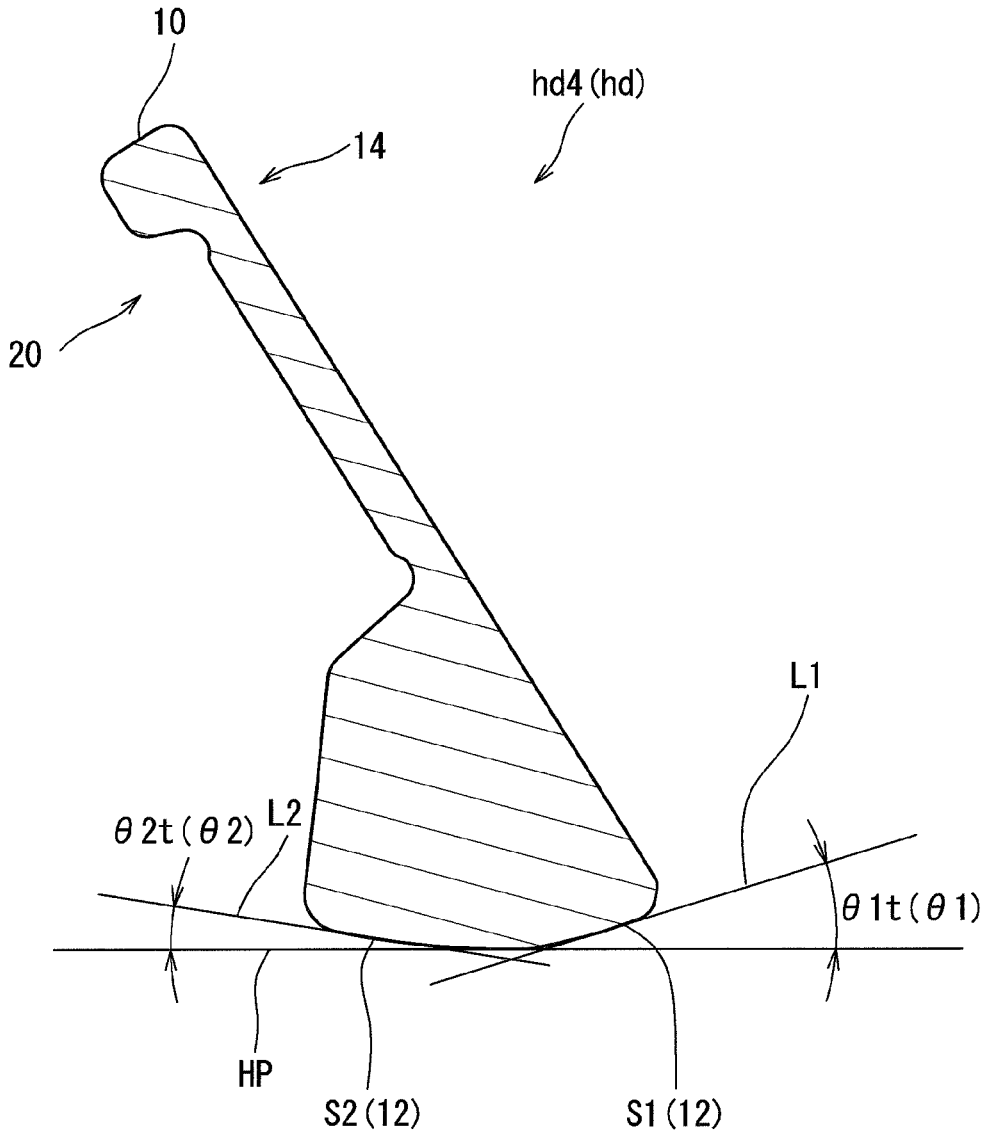
FIG. 11 is a sectional view taken along line F11-F11 of FIG. 8.
Figure 12:
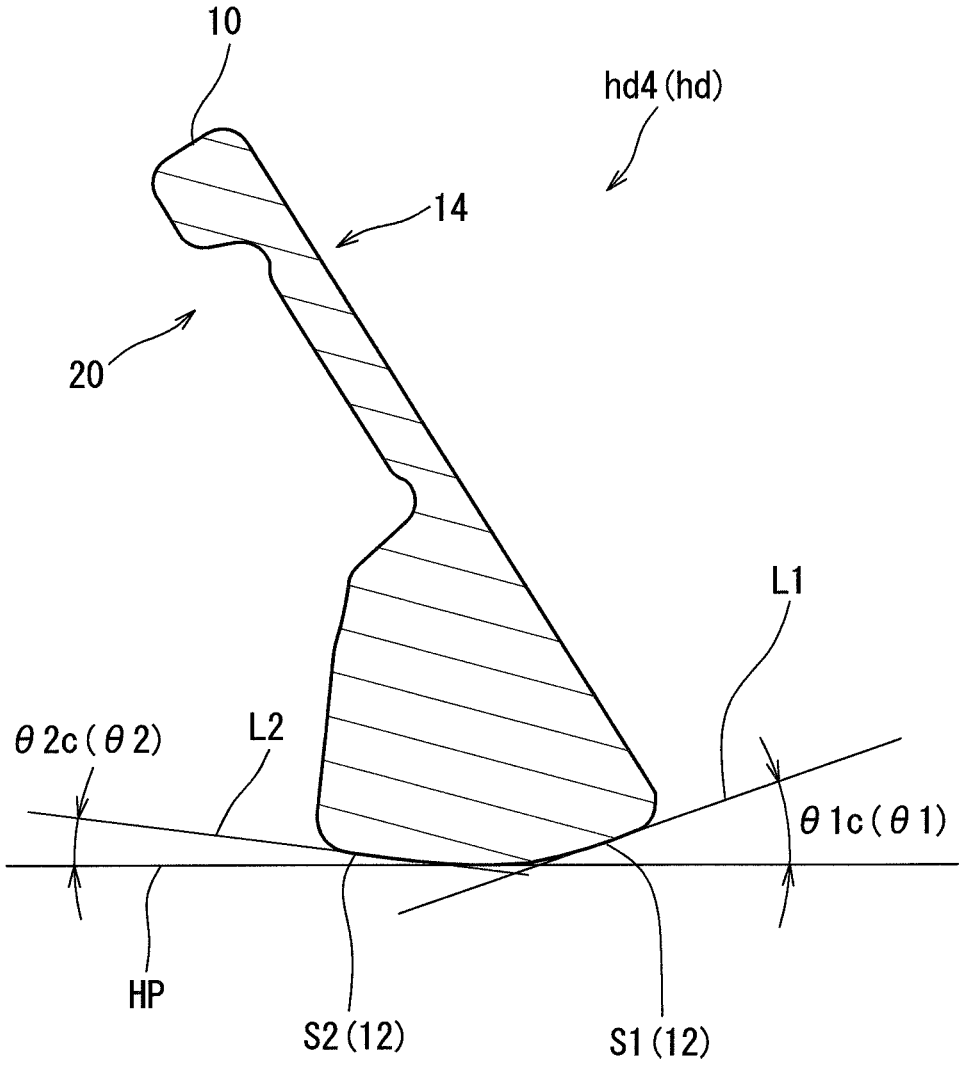
FIG. 12 is a sectional view taken along line F12-F12 of FIG. 8.
Figure 13:
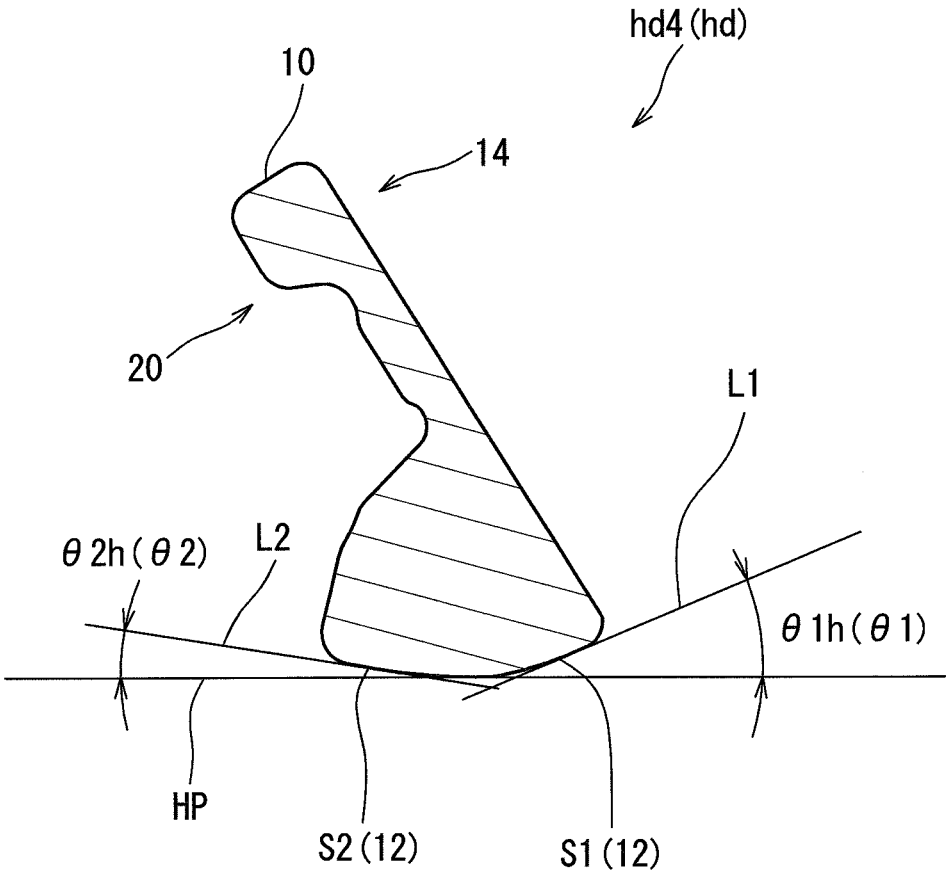
FIG. 13 is a sectional view taken along line F13-F13 of FIG. 8.

FIG. 8 is a front view of the head hd4 of the 7-iron (the above second club), as viewed from a direction perpendicular to a face surface. FIG. 9 is a side view of the head hd4. FIG. 10 is a bottom view of the head hd4, as viewed from a sole side. FIG. 11 is a sectional view taken along line F11-F11 of FIG. 8. FIG. 12 is a sectional view taken along line F12-F12 of FIG. 8. FIG. 13 is a sectional view taken along line F13-F13 of FIG. 8.

Figure 14:
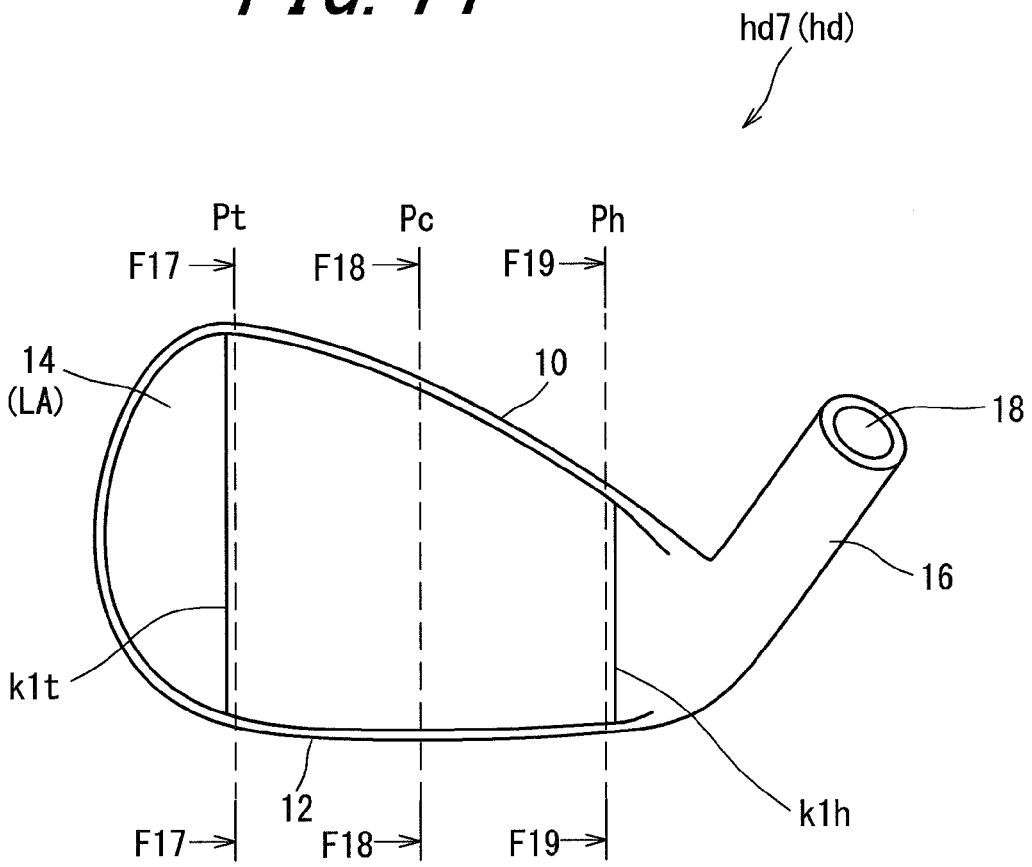
FIG. 14 is a front view of a head (pitching wedge) included in the set of FIG. 1, as viewed from the front of a face.
Figure 15:
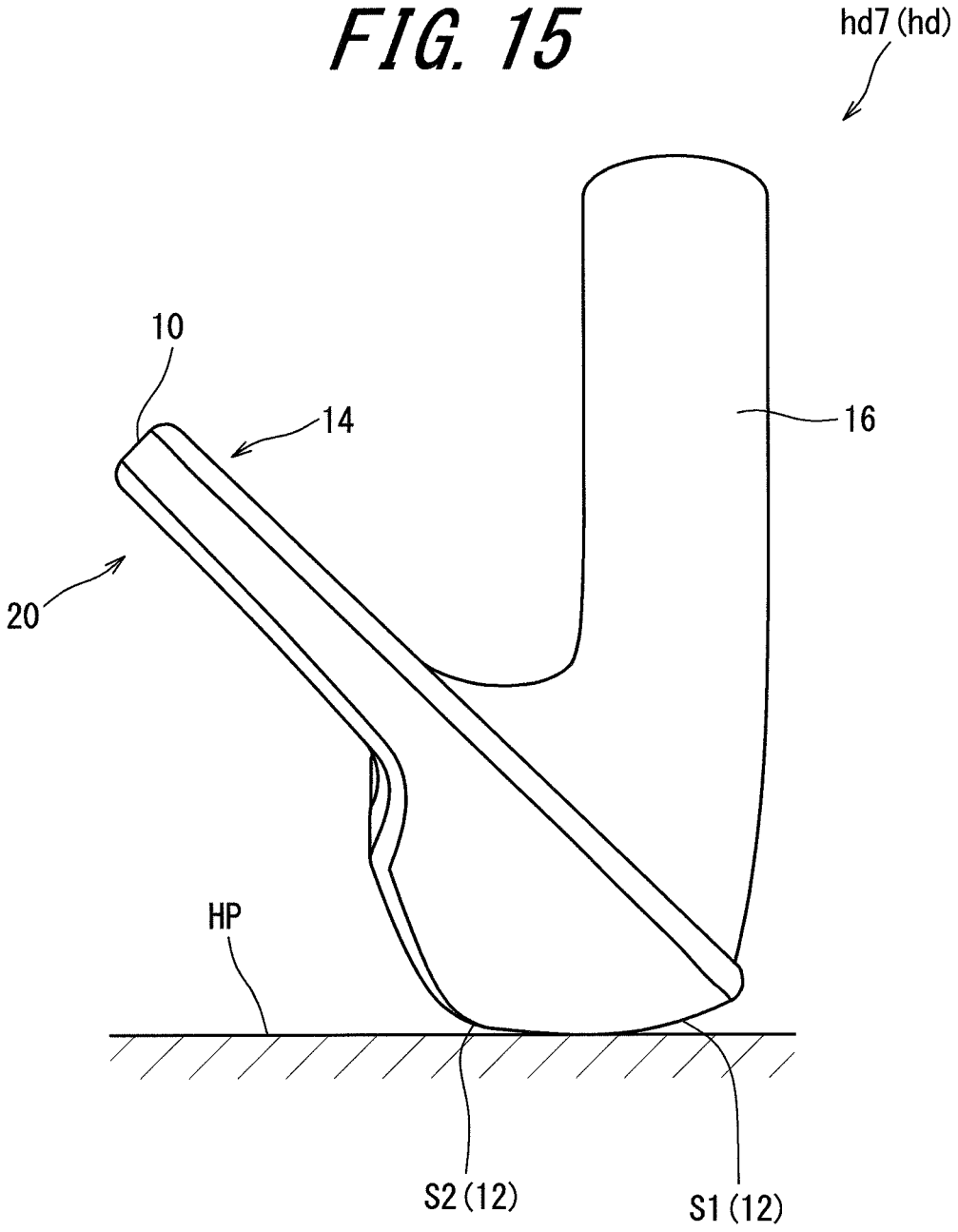
FIG. 15 is a side view of the head of FIG. 14.
Figure 16:
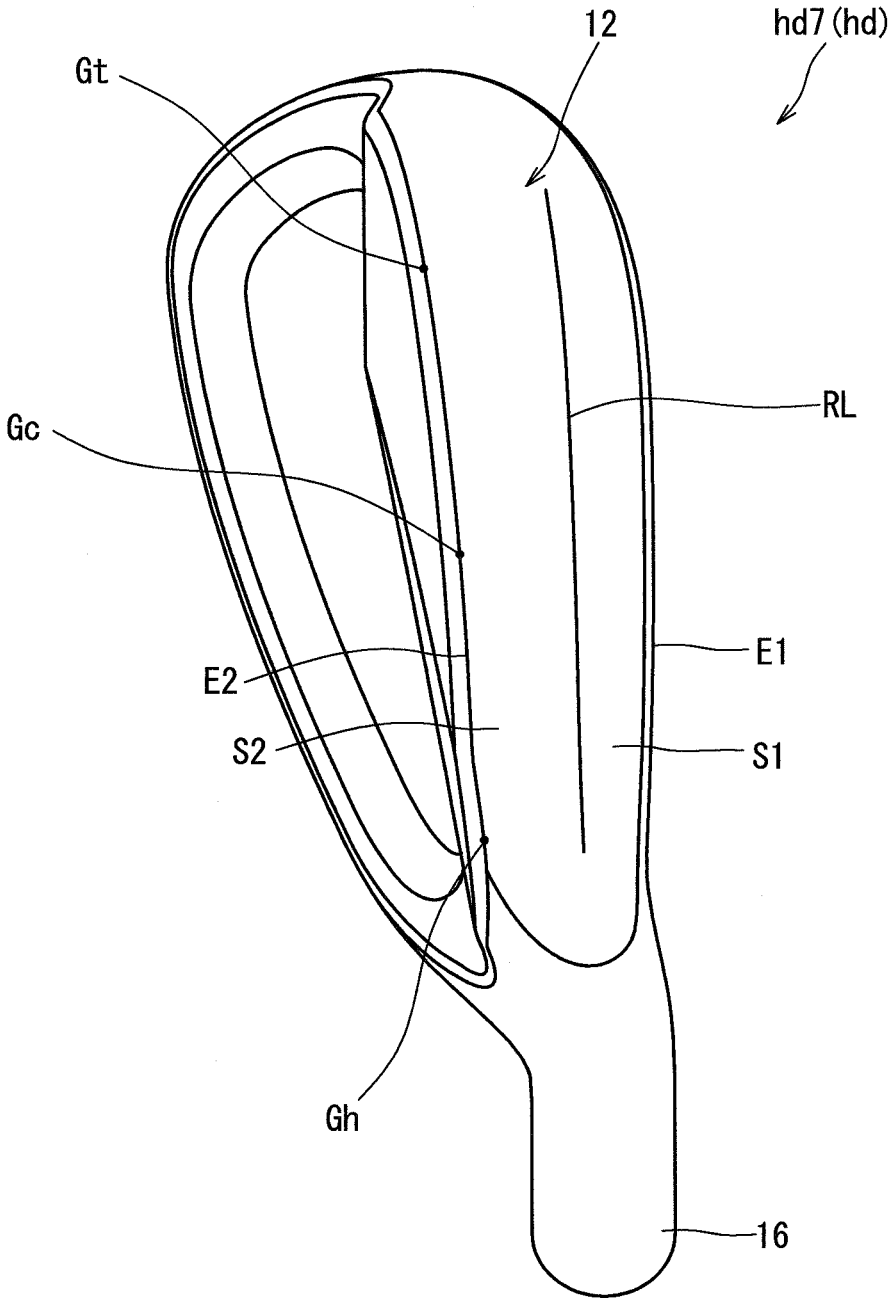
FIG. 16 is a bottom view of the head of FIG. 14.
Figure 17:
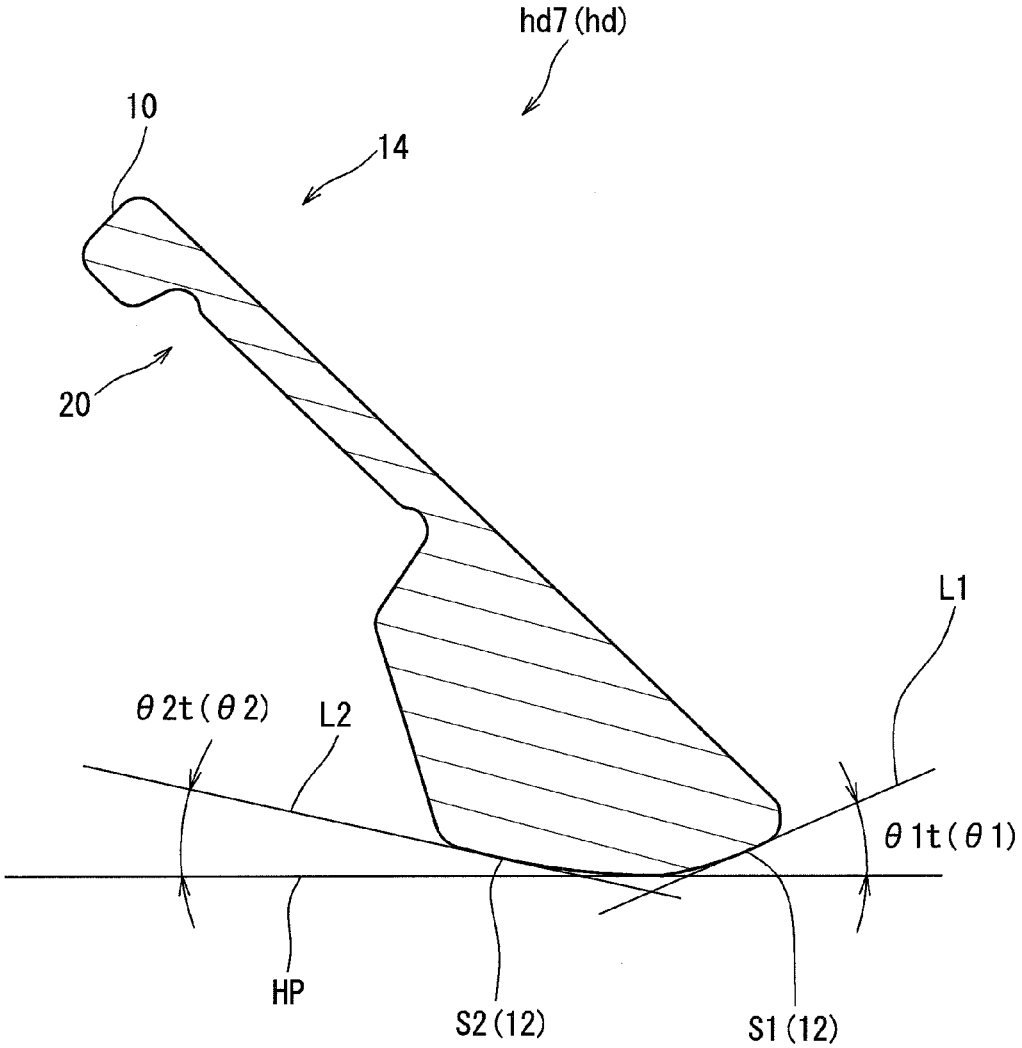
FIG. 17 is a sectional view taken along line F17-F17 of FIG. 14.
Figure 18:
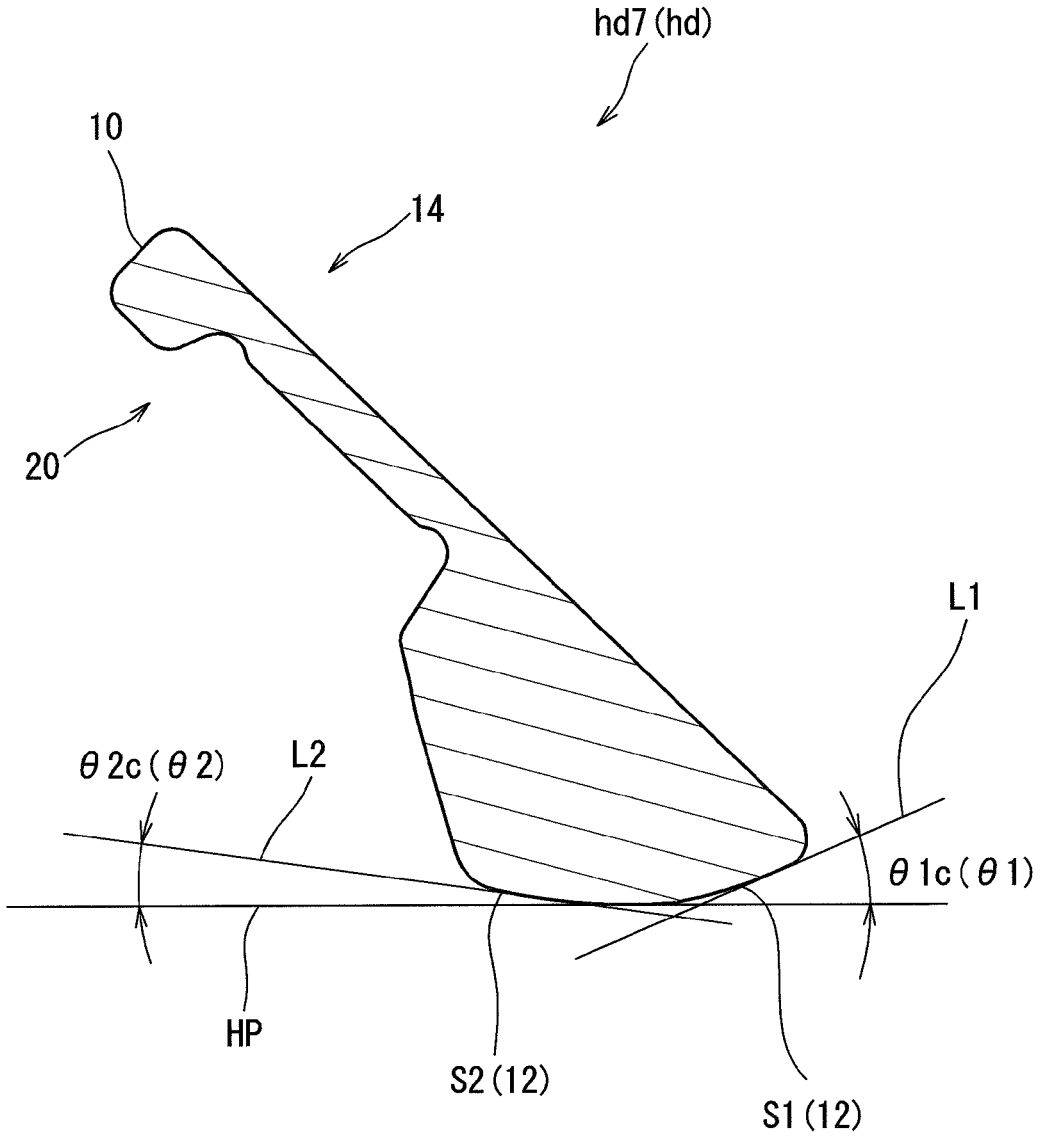
FIG. 18 is a sectional view taken along line F18-F18 of FIG. 14.
Figure 19:
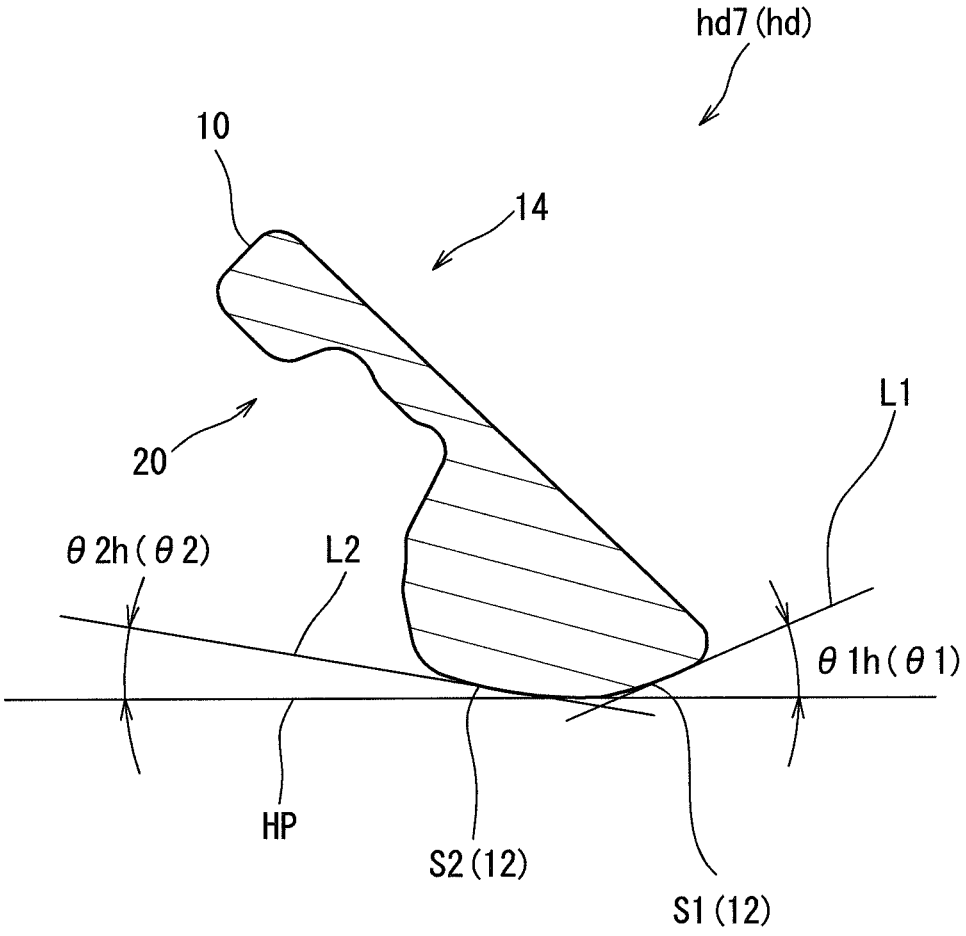
FIG. 19 is a sectional view taken along line F19-F19 of FIG. 14.

FIG. 14 is a front view of the head hd7 of the pitching wedge (the above third club), as viewed from a direction perpendicular to a face surface. FIG. 15 is a side view of the head hd7. FIG. 16 is a bottom view of the head hd7, as viewed from a sole side. FIG. 17 is a sectional view taken along line F17-F17 of FIG. 14. FIG. 18 is a sectional view taken along line F18-F18 of FIG. 14. FIG. 19 is a sectional view taken along line F19-F19 of FIG. 14.

Hereinafter, portions described as the head hd are matters common to all the iron numbers.

As shown in FIGS. 2 to 19, the head hd has a top surface 10, a sole surface 12, a face surface 14, and a hosel 16. The face surface 14 is a surface hitting a ball. The sole surface 12 forms a lower surface of the head hd. The sole surface 12 forms a surface projecting toward a lower side as a whole. The hosel 16 is positioned on a heel side of the head hd. The hosel 16 has a shaft hole 18 (see FIGS. 2, 8, and 14). The center axis line Z of the shaft hole 18 coincides with the axis line of the shaft.

The head hd further includes a back surface 20. The back surface 20 is a surface opposite to the face surface 14. A cavity (recess) is formed in the back surface 20. That is, the head hd is a so-called cavity back iron.

The material of the head hd is not limited. The head hd may be a metal, or may be a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include carbon fiber reinforced plastic (CFRP). The materials of a face portion and other portion may be different from each other.

The face surface 14 has a face line gv. The face line gv is also referred to as a score line or a face groove. The head hd1 has a plurality of face lines gv. Examples of a formation method of the face lines gv include forging, a press process, casting, and a cut process (carving). The plurality of face lines gv include the longest face line gv1. The description of the face line gv is omitted except for FIG. 2.

A part of the face surface 14 is subjected to a treatment for adjusting a surface roughness (see FIGS. 2, 8, and 14). The typical example of the treatment is a shot-blasting treatment. In the present embodiment, the shot-blasting treatment is adopted. As shown in FIG. 2, boundary lines k1 are visually recognized at boundaries between an area which is subjected to the shot-blasting treatment and an area which is not subjected to the shot-blasting treatment. The boundary lines k1 are a toe side boundary line kit and a heel side boundary line k1*h*. An area between the boundary line kit and the boundary line k1*h* is subjected to the shot-blasting treatment. All the face lines gv are formed in the area which is subjected to the shot-blasting treatment. An area on a toe side with respect to the toe side boundary line kit is not subjected to the shot-blasting treatment. An area on a heel side with respect to the heel side boundary line k1*h* is not subjected to the shot-blasting treatment. The toe side boundary line kit and the heel side boundary line k1*h* are visually recognized by the absence or presence of the shot-blasting treatment. The surface roughness is increased by the shot-blasting treatment. The increased surface roughness can increase a backspin rate.

The face surface 14 has a land area LA. The land area LA indicates a portion on which the face lines gv are not formed, of the face surface 14. If minute convexoconcave formed by the shot-blasting treatment or the like is disregarded, the land area LA is substantially a plane. Therefore, in the present application, the face surface 14 is treated as a plane. In the iron head hd, the face surface 14 is usually a plane.

As shown in FIGS. 4, 10, and 16, the sole surface 12 includes a ridgeline RL extending from a toe side toward a heel side, a leading surface S1 positioned on a face side of the ridgeline RL, and a trailing surface S2 positioned on a back side of the ridgeline RL. The ridgeline RL is a boundary line between the leading surface S1 and the trailing surface S2. The leading surface S1 extends between the ridgeline RL and a leading edge E1. The trailing surface S2 extends between the ridgeline RL and a trailing edge E2.

The leading surface S1 is a convex curved surface which smoothly continues as a whole. The trailing surface S2 is a convex curved surface which smoothly continues as a whole. The ridgeline RL is three-dimensionally curved so as to project toward a lower side.

The ridgeline RL is formed by a vertex of the sole surface 12. The ridgeline RL is a line which can be visually recognized. In the section taken along the face-back direction, the ridgeline RL constitutes the vertex of the sole surface 12. The vertex may have roundness, and the roundness preferably has a curvature radius of equal to or less than 7 mm.

In all positions in the toe-heel direction, the sections taken along the face-back direction may be defined. In all the sections, the ridgeline RL constitutes a lowest point.

The projection height of the ridgeline RL is decreased from the toe reference position Pt toward the heel reference position Ph. The projection height is a distance (shortest distance) between the ridgeline RL and a straight line connecting the leading edge E1 to the trailing edge E2.

The leading surface S1 extends from the ridgeline RL toward the face side. A face side end of the leading surface S1 is the leading edge E1 (see FIGS. 4, 10, and 16). The leading surface S1 is inclined upward toward the face side. Although the leading surface S1 is a curved surface projecting toward an outer side, it is close to a plane. From the viewpoint to be described later, the leading surface S1 is preferably a plane or close to a plane. Therefore, in the section taken along the face-back direction, the leading surface S1 preferably has a curvature radius of equal to or greater than 20 mm. The leading surface S1 may be a plane. In the section taken along the face-back direction, the leading surface S1 may be a straight line.

The trailing surface S2 extends from the ridgeline RL toward the back side. A rear edge of the trailing surface S2 is the trailing edge E2 (see FIGS. 4, 10, and 16). The trailing surface S2 is inclined upward toward the back side. Although the trailing surface S2 is a curved surface projecting toward an outer side, it is close to a plane. From the viewpoint to be described later, preferably the trailing surface S2 is a plane or close to a plane. Therefore, in the section taken along the face-back direction, the trailing surface S2 preferably has a curvature radius of equal to or greater than 30 mm. The trailing surface S2 may be a plane. In the section taken along the face-back direction, the trailing surface S2 may be a straight line.

Thus, the sectional shape of the sole surface 12 in the section taken along the face-back direction is a chevron with the ridgeline RL as the vertex. Only the ridgeline RL is brought into contact with the horizontal plane HP in the reference state. As is understood from FIG. 2 or the like, the sectional shape of the sole surface 12 in the section taken along the toe-heel direction is curved so as to project toward a lower side. A portion (contact portion) which is brought into contact with the horizontal plane HP in the reference state is one place on the ridgeline RL. In the reference state, a gap between the ridgeline RL and the horizontal plane HP is increased from the contact portion toward the toe side. In the reference state, the gap between the ridgeline RL and the horizontal plane HP is increased from the contact portion toward the heel side.

[Effect of Ridgeline Sole]

The structure having the leading surface S1 and the trailing surface S2 with the ridgeline RL as a boundary exhibits the following effect.

Before the ridgeline RL passes through the ground near an impact, the leading surface S1 is opposed to the ground. However, the leading surface S1 does not largely project toward the ground, which provides a reduction in resistance received from the ground. As a result, a reduction in a head speed involving the ground resistance can be suppressed.

When a swing further proceeds, the ridgeline RL is grounded. Since the sole surface 12 projects in the ridgeline RL, the sole surface 12 intensively receives the resistance from the ground in the ridgeline RL. For this reason, the head hd is rotated at once by grounding the ridgeline RL. The head hd is rotated so that the head hd falls over forward around the ridgeline RL. The rotation of the head hd is rotation in a direction in which the loft angle (loft angle with respect to vertical line) of the head hd is decreased. A gear effect is provided by the rotation of the head hd. Since the ridgeline RL intensively receives the resistance from the ground, the gear effect is provided at once. The gear effect provides an increase in the backspin rate. When the sole surface is a mere convex surface, the convex surface already receives the resistance on the face side with respect to the ridgeline RL, which provides the dispersion of the resistance received by the sole surface 12. For this reason, the above rapid rotation of the head hd is not provided, which causes a decrease in the gear effect. Therefore, the increase effect of the backspin rate is also decreased.

After the ridgeline RL passes through the ground, the trailing surface S2 is opposed to the ground. However, the trailing surface S2 does not largely project toward the ground as with the leading surface S1, which provides a reduction in the resistance (ground resistance) received from the ground. As a result, a reduction in a head speed involving the ground resistance can be suppressed, which can provide an improvement in coming loose performance.

[Inclination Angles θ1, θ1*t*, θ1*c*, θ1*h* of Leading Surface]

The inclination angle of the leading surface S1 is shown by a double-headed arrow θ1 in FIGS. 5, 6, and 7 or the like. In the reference state, the section taken along the face-back direction is considered. In the section, a straight line L1 taken along the leading surface S1 is defined. When the sectional line of the leading surface S1 is a curved line, the tangent of a middle point of the sectional line is defined as the straight line L1. An angle between the straight line L1 and the horizontal plane HP is the inclination angle θ1 of the leading surface S1. The middle point means a point bisecting the face-back direction width of the sectional line of the leading surface S1.

The inclination angle θ1 at the toe reference position Pt is an angle θ1*t* (see FIGS. 5, 11, and 17). The inclination angle θ1 at the central position Pc is an angle θ1*c* (see FIGS. 6, 12, and 18). The inclination angle θ1 at the heel reference position Ph is an angle θ1*h* (see FIGS. 7, 13, and 19).

In the set 2, the inclination angle θ1 is increased as the loft angle is increased. In more detail, the inclination angle θ1*t* is increased as the loft angle is increased. The inclination angle θ1*c* is increased as the loft angle is increased. The inclination angle θ1*h* is increased as the loft angle is increased.

The comparatively short club 4 (for example, the above third club) is most commonly used for a shot targeting a comparatively narrow area such as a green.

For this reason, an increase in the backspin rate is required for the short club 4. In the set 2, the inclination angle θ1 in the short club 4 is increased, which can provide a further increase in the concentration of the ground resistance to the ridgeline RL. Therefore, the above head rotation is further promoted, which provides a further improvement in the gear effect. As a result, the backspin rate is further increased. Meanwhile, the inclination angle θ1 is decreased in the comparatively long club 4 (for example, the above first club), which suppresses excessive head rotation. As a result, the initial conditions (for example, launch angle, spin rate) of the shot are stabilized. In addition, ballooning (blow-up) caused by excessive backspin is prevented.

In each iron number of the set 2, a difference among the inclination angle θ1*t*, the inclination angle θ1*c*, and the inclination angle θ1*h* is comparatively small. The constitution stably provides the concentration of the ground resistance to the ridgeline RL even if the ground position fluctuates in the toe-heel direction. For this reason, the above fluctuation of the gear effect is decreased, which stabilizes the backspin rate. From this viewpoint, a difference between the inclination angle θ1*t* and the inclination angle θ1*c* in each head hd is preferably equal to or less than 3 degrees, and more preferably equal to or less than 2 degrees. Similarly, in each head hd, a difference between the inclination angle θ1*h* and the inclination angle θ1*c* is preferably equal to or less than 3 degrees, and more preferably equal to or less than 2 degrees.

[Inclination Angles θ2, θ2*t*, θ2*c*, θ2*h* of Trailing Surface]

The inclination angle of the trailing surface S2 is shown by a double-headed arrow θ2 in FIGS. 5, 6, and 7 or the like. In the reference state, the section taken along the face-back direction is considered. In the section, a straight line L2 taken along the trailing surface S2 is defined. When the sectional line of the trailing surface S2 is a curved line, the tangent of a middle point of the sectional line is defined as the straight line L2. An angle between the straight line L2 and the horizontal plane HP is the inclination angle θ2 of the trailing surface S2. The middle point means a point bisecting the face-back direction width of the sectional line of the trailing surface S2.

The inclination angle θ2 at the toe reference position Pt is an angle θ2*t* (see FIGS. 5, 11, and 17). The inclination angle θ2 at the central position Pc is an angle θ2*c* (see FIGS. 6, 12, and 18). The inclination angle θ2 at the heel reference position Ph is an angle θ2*h* (see FIGS. 7, 13, and 19).

Preferably, the head hd satisfies at least one of the following (a) and (b). More preferably, the head hd satisfies both the following (a) and (b):

(a) the inclination angle θ2*t* is greater than the inclination angle θ2*c* (θ2*t*>θ2*c*); and (b) the inclination angle θ2*h* is greater than the inclination angle θ2*c* (θ2*h*>θ2*c*).

The head hd1 (the first club) of the present embodiment satisfies the above (a). That is, in the head hd1, θ2*t*>θ2*c* is satisfied. The head hd4 (the second club) of the present embodiment satisfies the above (a). That is, in the head hd4, θ2*t*>θ2*c* is satisfied. The head hd7 (the third club) of the present embodiment satisfies the above (a). That is, in the head hd7, θ2*t*>θ2*c* is satisfied. In all the iron numbers of the set 2, θ2*t*>θ2*c* is satisfied.

The head hd1 (the first club) of the present embodiment satisfies the above (b). That is, in the head hd1, θ2*h*>θ2*c* is satisfied. The head hd4 (the second club) of the present embodiment satisfies the above (b). That is, in the head hd4, θ2*h*>θ2*c* is satisfied. The head hd7 (the third club) of the present embodiment satisfies the above (b). That is, in the head hd7, θ2*h*>θ2*c* is satisfied. In all the iron numbers of the set 2, θ2*h*>θ2*c* is satisfied.

The inclination angle θ2 is gradually or intermittently changed from the central position Pc toward the toe reference position Pt. The inclination angle θ2 is gradually or intermittently changed from the central position Pc toward the heel reference position Ph. The term "intermittently" means that a portion in which the inclination angle θ2 is constant may be included.

The inclination angle θ2 is gradually or intermittently increased from the central position Pc toward the toe reference position Pt. The inclination angle θ2 is gradually or intermittently increased from the central position Pc toward the heel reference position Ph.

The width of the leading surface S1 is shown by a double-headed arrow W1 in FIG. 4. The width W1 is measured along the face-back direction. The width of the trailing surface S2 is shown by a double-headed arrow W2 in FIG. 4. The width W2 is measured along the face-back direction. The width of the sole surface 12 is shown by a double-headed arrow WS in FIG. 4. The sole width WS is a distance between the leading edge E1 and the trailing edge E2. The width WS is measured along the face-back direction. The sole width WS is the sum of the width W1 and the width W2.

As shown in FIG. 5, the width W1 at the toe reference position Pt is W1*t*. As shown in FIG. 6, the width W1 at the central position Pc is W1*c*. As shown in FIG. 7, the width W1 at the heel reference position Ph is W1*h*. As shown in FIG. 5, the width W2 at the toe reference position Pt is W2*t*. As shown in FIG. 6, the width W2 at the central position Pc is W2*c*. As shown in FIG. 7, the width W2 at the heel reference position Ph is W2*h*. As shown in FIG. 5, the width WS at the toe reference position Pt is WSt. As shown in FIG. 6, the width WS at the central position Pc is WSc. As shown in FIG. 7, the width WS at the heel reference position Ph is WSh. The sole width WSt is the sum of the width W1*t* and the width W2*t*. The sole width WSc is the sum of the width W1*c* and the width W2*c*. The sole width WSh is the sum of the width W1*h* and the width W2*h*.

In the head hd, at the toe reference position Pt, the width W2*t* is greater than the width W1*t*. In the head hd, at the central position Pc, the width W2*c* is greater than the width W1*c*. In the head hd, at the heel reference position Ph, the width W2*h* is greater than the width W1*h*.

At all the positions in the toe-heel direction, the width W2 is greater than the width W1. From the viewpoint of improving the function of the trailing surface S2, at all the positions in the toe-heel direction, the width W2 is preferably greater than the width W1. From the viewpoint of also securing the function provided by the leading surface S1 while improving the function of the trailing surface S2, at all the positions in the toe-heel direction, W2/WS is preferably greater than 0.5 but 0.75 or less.

In FIGS. 4, 10, and 16, a point Gt is a point on the trailing edge E2, and is a point at the toe reference position Pt. A point Gc is a point on the trailing edge E2, and is a point at the central position Pc. A point Gh is a point on the trailing edge E2, and is a point at the heel reference position Ph. In the present application, the curvature radius of the trailing edge E2 is defined. In plane view as shown in FIG. 4, the curvature radius of a circle which passes through the three points (point Gt, point Gc, and point Gh) is defined as the curvature radius of the trailing edge E2. In the plane view, the circle which passes through the three points (point Gt, point Gc, and point Gh) is defined as a curvature definite circle.

If the sole width WS is rapidly changed, the resistance received by the head hd from the grass is apt to be unstable. Therefore, preferably, the sole width WS is gradually changed. From this viewpoint, preferably, the trailing edge E2 is substantially taken along the curvature definite circle. In other words, displacement between the trailing edge E2 and the curvature definite circle is preferably decreased. In light of this point, in the trailing edge E2 between the point Gt and the point Gh, a distance (displacement distance) between the curvature definite circle and the trailing edge E2 is preferably equal to or less than 4 mm, and more preferably equal to or less than 2 mm. The displacement distance is measured along the face-back direction.

In the head hd1 (the first club) of FIG. 4, the trailing edge E2 is substantially closer to a straight line. In the head hd4 (the second club) of FIG. 10, the trailing edge E2 is curved so as to project toward the face side. In the head hd7 (the third club) of FIG. 16, the trailing edge E2 is curved so as to project toward the face side. In the set 2, in all the clubs (iron numbers), the trailing edge E2 may be curved so as to project toward the face side. The set 2 may include a club (iron number) in which the trailing edge E2 projects toward the back side.

As described later, in the present embodiment, the heel and toe side of the trailing surface S2 effectively act. Therefore, the width W2 of the trailing surface S2 is preferably increased on the toe and heel side. From this viewpoint, the trailing edge E2 is preferably curved so as to project toward the face side.

Since the sole widths WS on the toe and heel sides are increased by the trailing edge E2 curved so as to project toward the face side, much weight is distributed to these areas. Therefore, the lateral moment of inertia of the head is increased. As a result, the lateral deviation (deviation involving rotation around an axis taken along the up-down direction) of the head hd at an impact is decreased, which stabilizes the direction of a hit ball. Also from this viewpoint, the trailing edge E2 is preferably curved so as to project toward the face side.

If an axis taken along the up-down direction and passing through the center of gravity of the head is defined as an up-down direction axis, the lateral moment of inertia is a moment of inertia about the up-down direction axis.

Since the rotation radius (radius of head path) of the swing is increased in the long club 4, the moving distance of the head hd while being brought into contact with the grass is increased. Therefore, in the long club 4, the head path while being brought into contact with the grass largely influences the directivity and the flight distance of the hit ball. By the trailing edge E2 curved as described above, the sole widths WS on the toe and heel sides are increased. For this reason, a contact area with the grass is increased on the toe and heel sides. The increased contact area functions as a guide when the head hd is slid on the surface of the grass, which stabilizes the head path. As a result, the directivity and the flight distance are stabilized. Since the long club 4 increases the flight distance, the stability of the directivity and the flight distance is particularly important. In light of them, the trailing edge E2 curved so as to project toward the face side is particularly effective in the long club 4. From this viewpoint, in the first club, the trailing edge E2 is preferably curved so as to project toward the face side.

[Effect of Inclination Angle θ2*c*]

In the head hd, the inclination angle θ2*c* is comparatively small. For this reason, the center portion of the trailing surface S2 is likely to be brought into contact with the grass. The center portion functions as a guide when the head hd is slid on the grass, which provides a decrease in the deviation of the head hd in the up-down direction. For this reason, the head path is stabilized.

[Effect of Inclination Angle θ2*h*]

In the head hd, the inclination angle θ2*h* is comparatively large. The inclination angle θ2*h* contributes to the coming loose of the sole surface 12 in sidehill lie (ball above feet). In the sidehill lie (ball above feet), a swing path is apt to become flat, and a hit ball in the case of a right-handed golfer is apt to fly leftward. In order to modify this, it is effective to perform a swing in a state where a face is slightly opened. In this case, the heel side of the sole surface 12 is apt to get into under the grass, which may cause increased resistance on the heel side of the sole surface 12. However, by the increased inclination angle θ2*h*, the heel side resistance is suppressed, which provides an improvement in coming loose performance.

In sidehill lie (ball below feet), inevitably, the heel side of the sole surface 12 is preferentially grounded. Therefore, increased resistance is apt to be caused on the heel side of the trailing surface S2. However, by the increased inclination angle θ2*h*, the resistance on the heel side of the trailing surface S2 is suppressed, which provides an improvement in coming loose performance.

[Effect of Inclination Angle θ2*t*]

High-level golf players including professional golfers may perform a special swing when intentionally applying strong backspin. In the swing, the head hd is taken as a toe down posture at an impact, and the toe side of the face surface 14 is slid into the lower side of the ball. The high-level golf players can perform the swing to apply strong backspin while catching the ball. The toe down posture means a state where the toe side of the head is lower than the heel side.

Since the head hd is taken as the toe down posture in the swing, the toe side of the sole surface 12 is apt to deeply get into under the grass. Therefore, increased resistance may be caused on the toe side of the trailing surface S2. However, by the increased inclination angle θ2*t*, the resistance on the toe side of the trailing surface S2 is suppressed, which provides an improvement in coming loose performance.

When strong backspin is desired to be intentionally applied, the leading surface S1 and the ridgeline RL effectively act. When the backspin is increased, a descending blow swing (an attack angle is large) is advantageous, but in this case, the front part of the sole is apt to catch the grass. However, since the leading surface S1 is provided in the head hd, the catching is suppressed. The top part including the ridgeline RL intensively receives resistance, which can efficiently and stably provide the gear effect as described above.

[Flows of Inclination Angle θ2*t* and Inclination Angle θ2*h*]

A preferable set 2 satisfies at least one of the following (c) and (d). A more preferable set 2 satisfies both the following (c) and (d). The set 2 of the present embodiment satisfies both the following (c) and (d):

(c) the inclination angle θ2*t* is increased as the loft angle is increased.

(d) the inclination angle θ2*h* is increased as the loft angle is increased.

The above (c) can be put otherwise as follows:

(c) the inclination angle θ2*t* is increased as the club length is decreased.

The above (d) can be put otherwise as follows:

(d) the inclination angle θ2*h* is increased as the club length is decreased.

Therefore, the inclination angle θ2*t* of the head hd7 (the third club) is greater than the inclination angle θ2*t* of the head hd4 (the second club). The inclination angle θ2*t* of the head hd4 (the second club) is greater than the inclination angle θ2*t* of the head hd1 (the first club).

The inclination angle θ2*h* of the head hd7 (the third club) is greater than the inclination angle θ2*h* of the head hd4 (the second club). The inclination angle θ2*h* of the head hd4 (the second club) is greater than the inclination angle θ2*h* of the head hd1 (the first club).

[Effects of Flows of θ2*t* and θ2*h* (Comparatively Long Club)]

Since the rotation radius (radius of head path) of the swing in the long club 4 is increased, the moving distance of the head hd while being brought into contact with the grass is increased. Since the long club 4 is used for a shot having a long flight distance, the chance of intentionally applying strong backspin is reduced. Therefore, preferably, in the long club 4, the head hd is stably slid on the grass surface to stabilize the head path. By decreasing the inclination angle θ2*t* and the inclination angle θ2*h*, the trailing surface S2 is likely to be brought into contact with the grass surface. Therefore, the trailing surface S2 functions effectively as a guide when the head hd is slid on the grass surface. As a result, the head path is stabilized to improve a flight distance and directional stability.

[Effect of Flow of θ2*t* (Comparatively Short Club)]

The short club 4 is most commonly used for a shot targeting a narrow area such as a green. Therefore, a shot intentionally applying strong backspin is most commonly required. In this case, as described above, strong backspin can be applied by a special swing involving a toe down posture. By increasing the inclination angle θ2*t*, the ground resistance on the toe side is decreased even if an impact is performed at the toe down posture. Therefore, coming loose performance is improved.

[Effect of Flow of θ2*h* (Comparatively Short Club)]

In the club 4 having a large loft angle, a hit ball is apt to fly leftward in sidehill lie (ball above feet) (in the case of a right-handed golfer). In order to modify this, it is effective to perform a swing in a state where a face is slightly opened. In this case, the heel side of the sole surface 12 is apt to get into under the grass, which may cause increased resistance on the heel side. However, by increasing the inclination angle θ2*h*, the resistance on the heel side is suppressed, which provides an improvement in coming loose performance.

In golf, a trajectory may be desired to be intentionally curved. When a hit ball is intentionally sliced, a swing is performed in an outside-in head path. When a hit ball is intentionally hooked, a swing is performed in an inside-out head path. When a hit ball is intentionally curved by the short club 4, it is necessary to provide a more extreme head path. This is because it is necessary to curve a shot in a short flight distance. Since the heel side of the sole surface 12 precedes as compared with the toe side when an outside-in degree is increased, the heel side deeply gets into under the grass. Therefore, the heel side of the sole surface 12 receives increased resistance. When the inside-out degree is increased, the shaft tends to lie down (the shaft is close to horizontal) at an impact. In the state where the shaft lies down, the head hd is apt to take a toe up posture. At the toe up posture, the heel side of the sole surface 12 deeply gets into under the grass, and receives increased resistance. The toe up posture means a state where the toe side of the head is higher than the heel side.

Thus, in the swing for intentionally curving the hit ball by the short club 4, the heel side of the sole surface 12 receives the increased resistance. However, by increasing the inclination angle θ2*h*, the resistance on the heel side is suppressed, which provides an improvement in coming loose performance.

[Flows of Toe Angle Difference and Heel Angle Difference]

A difference (θ2*t*−θ2*c*) between the inclination angle θ2*t* and the inclination angle θ2*c* is defined as the toe angle difference. A difference (θ2*h*−θ2*c*) between the inclination angle θ2*h* and the inclination angle θ2*c* is defined as the heel angle difference.

A preferable set 2 satisfies at least one of the following (e) and (f). A more preferable set 2 satisfies both the following (e) and (f). A set 2 of the present embodiment satisfies both the following (e) and (f):

(e) the toe angle difference is increased as the loft angle is increased.

(f) the heel angle difference is increased as the loft angle is increased.

The above (e) can be put otherwise as follows:

(e) the toe angle difference is increased as the club length is decreased.

The above (f) can be put otherwise as follows:

(f) the heel angle difference is increased as the club length is decreased.

Therefore, the toe angle difference of the head hd7 (the third club) is greater than the toe angle difference of the head hd4 (the second club). The toe angle difference of the head hd4 (the second club) is greater than the toe angle difference of the head hd1 (the first club).

The heel angle difference of the head hd7 (the third club) is greater than the heel angle difference of the head hd4 (the second club). The heel angle difference of the head hd4 (the second club) is greater than the heel angle difference of the head hd1 (the first club).

[Effects of Flows of Toe Angle Difference and Heel Angle Difference (Comparatively Long Club)]

Since the rotation radius (radius of head path) of the swing in the long club 4 is increased, the moving distance of the head hd while being brought into contact with the grass is increased. Since the long club 4 is used for a shot having a long flight distance, the chance of intentionally applying strong backspin is reduced. Therefore, preferably, in the long club 4, the head hd is stably slid on the grass surface to stabilize the head path. By decreasing the toe angle difference and the heel angle difference, the toe and heel sides of the trailing surface S2 are moved closer to the grass surface. Therefore, the ground contact area of the sole surface 12 is increased, and the trailing surface S2 functions as a guide when the head hd is slid on the grass surface. As a result, the head path is stabilized to improve a flight distance and directional stability.

[Effect of Flow of Toe Angle Difference (Comparatively Short Club)]

The short club 4 is most commonly used for a shot targeting a narrow area such as a green. Therefore, a shot intentionally applying strong backspin is most commonly performed. In this case, as described above, strong backspin can be applied by a special swing involving a toe down posture. By increasing the toe angle difference, the ground resistance on the toe side is decreased even if an impact is performed at the toe down posture. Therefore, coming loose performance is improved.

[Effect of Flow of Heel Angle Difference (Comparatively Short Club)]

In the club 4 having a large loft angle, a hit ball is apt to fly leftward in sidehill lie (ball above feet) (in the case of a right-handed golfer). In order to modify this, it is effective to perform a swing in a state where a face is slightly opened. In this case, the heel side of the sole surface 12 is apt to get into under the grass, which may cause increased resistance on the heel side. However, by increasing the heel angle difference, the resistance on the heel side is suppressed, which provides an improvement in coming loose performance.

When a hit ball is intentionally sliced, a swing is performed in an outside-in head path. When a hit ball is intentionally hooked, a swing is performed in an inside-out head path. When a hit ball is intentionally curved by the short club 4, it is necessary to provide a more extreme head path. This is because it is necessary to curve a shot in a short flight distance. Since the heel side of the sole surface 12 precedes as compared with the toe side when an outside-in degree is increased, the heel side deeply gets into under the grass. Therefore, the heel side of the sole surface 12 receives increased resistance. When the inside-out degree is increased, an impact is apt to be performed in a state where the shaft lies down (the shaft is close to horizontal), and thereby the head hd is apt to take a toe up posture. Therefore, also in this case, the heel side deeply gets into under the grass, and receives increased resistance.

Thus, when the hit ball is intentionally curved by the short club 4, the heel side of the sole surface 12 receives the increased resistance. However, by increasing the heel angle difference, the resistance on the heel side is suppressed, which provides an improvement in coming loose performance.

As described above, the set 2 has the following constitutions (c), (d), (e), and (f):

(c) the inclination angle θ2*t* is increased as the loft angle is increased;

(d) the inclination angle θ2*h* is increased as the loft angle is increased;

(e) the toe angle difference is increased as the loft angle is increased; and (f) the heel angle difference is increased as the loft angle is increased.

In the set 2, the above (c), (d), (e), and (f) can exhibit effects which are independent of each other. Therefore, the set 2 preferably has at least one selected from the group consisting of (c), (d), (e), and (f). More preferably, the set 2 has at least two selected from the group consisting of (c), (d), (e), and (f). Still more preferably, the set 2 has at least three selected from the group consisting of (c), (d), (e), and (f). Yet still more preferably, the set 2 has (c), (d), (e), and (f).

The set 2 may satisfy the following (g) or (h):

(g) the inclination angle θ2*c* is increased as the loft angle is increased; and (h) the inclination angle θ2*c* is substantially constant regardless of the loft angle. The phrase "substantially constant" means that a difference between the maximum value and the minimum value of the inclination angle θ2*c* is equal to or less than 2.5 degrees in the set 2.

When the above (g) is satisfied, the following effect is provided. Since the rotation radius (radius of head path) of the swing is increased in the long club 4, the moving distance of the head hd while being brought into contact with the grass is increased. Since the long club 4 is used for a shot having a long flight distance, the chance of intentionally applying strong backspin is reduced. Therefore, preferably, in the long club 4, the head hd is stably slid on the grass surface to stabilize the head path. By decreasing the inclination angle θ2*c* in the long club 4, the ground contact area of the sole surface 12 is increased, and the trailing surface S2 functions as a guide when the head hd is slid on the grass surface. As a result, the head path is stabilized to improve a flight distance and directional stability. Meanwhile, since the rotation radius (radius of head path) of the swing is decreased in the short club 4, the head hd comes in the grass surface at an acute angle (at a large attack angle) with respect to the grass surface, and the head hd leaves the grass surface at an acute angle with respect to the grass surface after an impact. Therefore, after the impact, in the short club 4, the trailing surface S2 is likely to be strongly brought into contact with the grass surface as compared with the long club 4. Therefore, the resistance (ground resistance) received by the trailing surface S2 from the grass surface is reduced by increasing the inclination angle θ2*c* in the short club 4. As a result, a reduction in a head speed involving the ground resistance can be suppressed, which can provide an improvement in coming loose performance.

The present disclosure according to the club can be applied to all golf clubs such as wood type, hybrid type, and iron type golf clubs. The golf club is preferably the iron type and hybrid type golf clubs, and more preferably the iron type golf club. An iron type hybrid (iron type utility) golf club in which a face surface is a plane is included in the iron type golf club in the present application. The present disclosure according to the set can be applied to all golf club sets.

The above description is only illustrative and various changes can be made without departing from the scope of the present disclosure.

What is claimed is:

1. A golf club comprising:

a shaft;

a head attached to a tip part of the shaft; and a grip attached to a rear end part of the shaft, wherein:

the head includes a sole surface and a face surface having a face line;

the sole surface includes a ridgeline extending from a toe side toward a heel side, a leading surface positioned on a face side of the ridgeline and inclined upward toward the face side, and a trailing surface positioned on a back side of the ridgeline and inclined upward toward the back side; and if an inclination angle of the trailing surface is defined as θ2; the inclination angle θ2 at a central position of the face line is defined as θ2*c*; the inclination angle θ2 at a toe reference position is defined as θ2*t*; and the inclination angle θ2 at a heel reference position is defined as θ2*h*, the golf club satisfies at least one of the following (a) and (b):

(a) the inclination angle θ2*t* is greater than the inclination angle θ2*c;*

(b) the inclination angle θ2*h* is greater than the inclination angle θ2*c*.

2. The golf club according to claim 1, wherein the golf club satisfies both the following (a) and (b):

(a) the inclination angle θ2*t* is greater than the inclination angle θ2*c;*

(b) the inclination angle θ2*h* is greater than the inclination angle θ2*c*.

3. The golf club according to claim 1, wherein a trailing edge which is a rear edge of the trailing surface is curved so as to project toward the face side.

4. The golf club according to claim 1, wherein a width of the trailing surface is greater than a width of the leading surface at all positions in a toe-heel direction.

5. The golf club according to claim 1, wherein the head is an iron type head.

6. A golf club set constituted by the golf clubs according to claim 1, and comprising the two or more golf clubs having different loft angles, the golf club set satisfies at least one of the following (c) and (d):

(c) the inclination angle θ2*t* is increased as the loft angle is increased;

(d) the inclination angle θ2*h* is increased as the loft angle is increased.

7. The golf club set according to claim 6, wherein the golf club set satisfies both the following (c) and (d):

(c) the inclination angle θ2*t* is increased as the loft angle is increased;

(d) the inclination angle θ2*h* is increased as the loft angle is increased.

8. The golf club set according to claim 6, wherein the inclination angle θ2*c* is increased as the loft angle is increased.

9. The golf club set according to claim 6, wherein if an inclination angle of the leading surface is defined as θ1; the inclination angle θ1 at the central position is defined as θ1*c*; the inclination angle θ1 at the toe reference position is defined as θ1*t*; and the inclination angle θ1 at the heel reference position is defined as θ1*h*, the angle θ1*t* is increased as the loft angle is increased;

the angle θ1*c* is increased as the loft angle is increased; and the angle θ1*h* is increased as the loft angle is increased.

10. A golf club set constituted by the golf clubs according to claim 1 and comprising the two or more golf clubs having different loft angles, wherein if a difference (θ2*t*−θ2*c*) between the inclination angle θ2*t* and the inclination angle θ2*c* is defined as a toe angle difference, and a difference (θ2*h*−θ2*c*) between the inclination angle θ2*h* and the inclination angle θ2*c* is defined as a heel angle difference, the golf club set satisfies at least one of the following (e) and (f):

(e) the toe angle difference is increased as the loft angle is increased;

(f) the heel angle difference is increased as the loft angle is increased.

11. The golf club set according to claim 10, wherein the golf club set satisfies both the following (e) and (f):

(e) the toe angle difference is increased as the loft angle is increased;

(f) the heel angle difference is increased as the loft angle is increased.

* * * * *